US009453322B2

(12) United States Patent
Milton et al.

(10) Patent No.: US 9,453,322 B2
(45) **Date of Patent: *Sep. 27, 2016**

(54) CELLULAR CONFINEMENT SYSTEMS

(71) Applicants: J & S Franklin Ltd., London (GB); Terram Limited, Gwent (GB)

(72) Inventors: Jeremy Milton, Bridport (GB); Basil John Thomas, Abergavenny (GB)

(73) Assignees: J & S Franklin, Ltd., London (GB); Fiberweb Geosynthetics Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/863,827

(22) Filed: Apr. 16, 2013

(65) Prior Publication Data

US 2013/0294847 A1 Nov. 7, 2013

Related U.S. Application Data

(63) Continuation-in-part of application No. 12/442,756, filed as application No. PCT/GB2007/003630 on Sep. 24, 2007, now Pat. No. 8,425,158.

(30) Foreign Application Priority Data

Sep. 25, 2006 (GB) ..... 0618868.4
Jun. 27, 2007 (GB) ..... 0712510.7

(51) Int. Cl.
*E02D 17/20* (2006.01)
*E02D 29/02* (2006.01)

(52) U.S. Cl.
CPC ..... *E02D 29/02* (2013.01)

(58) Field of Classification Search
CPC ..... B65D 21/0233
USPC ..... 405/15–17, 302.4, 302.6, 302.7, 262, 405/284; 383/38; 493/391, 966; 220/23.6, 220/23.86, 507; 206/509, 511, 821; 404/35, 404/36
See application file for complete search history.

(56) References Cited

U.S. PATENT DOCUMENTS

| | | | |
|---|---|---|---|
| 4,530,622 | A | 7/1985 | Mercer |
| 4,572,705 | A | 2/1986 | Vignon et al. |
| 4,726,708 | A | 2/1988 | Papetti |
| 4,797,026 | A | 1/1989 | Webster |
| 5,333,970 | A | 8/1994 | Heselden |
| 5,927,906 | A | 7/1999 | Bach et al. |
| 6,893,193 | B2 | 5/2005 | Santha |
| 8,425,158 | B2 * | 4/2013 | Milton et al. ..... 405/302.7 |

(Continued)

FOREIGN PATENT DOCUMENTS

| | | |
|---|---|---|
| CN | 2683703 | 3/2005 |
| CN | 2703793 | 6/2005 |

(Continued)

*Primary Examiner* — Sean Andrish
(74) *Attorney, Agent, or Firm* — Diederiks & Whitelaw, PLC

(57) ABSTRACT

A cellular confinement system for soil, sand or other filler material comprises a number of sub-assemblies each made up of a plurality of interconnected open cells of fabric material. The sub-assemblies are stackable one on top of the other to provide a structure having at least one generally vertical side or end wall. Each sub-assembly comprises a skirt portion which is arranged to overlap between vertically juxtaposed sub-assemblies in use. The skirt portion substantially prevents or minimizes the escape of finer aggregate material from between the stacked sub-assemblies.

18 Claims, 16 Drawing Sheets

(56) References Cited

U.S. PATENT DOCUMENTS

| | | | | |
|---|---|---|---|---|
| 2004/0151404 | A1 | 8/2004 | Richardson, Jr. et al. | |
| 2005/0117978 | A1 | 6/2005 | Loffel | |
| 2005/0123355 | A1 | 6/2005 | Kolenski et al. | |
| 2005/0170720 | A1 | 8/2005 | Christiansen et al. | |
| 2006/0147275 | A1 | 7/2006 | Lin et al. | |
| 2006/0147276 | A1 | 7/2006 | Lin et al. | |
| 2008/0131212 | A1* | 6/2008 | Quinley et al. | 405/302.6 |
| 2009/0235813 | A1 | 9/2009 | Cashin et al. | |
| 2009/0235814 | A1 | 9/2009 | Cashin et al. | |

FOREIGN PATENT DOCUMENTS

| | | | |
|---|---|---|---|
| EP | 285378 | | 10/1988 |
| EP | 378 309 | | 7/1990 |
| EP | 378 310 | | 7/1990 |
| FR | 2699948 | | 7/1994 |
| FR | 2699948 | * | 2/1995 |
| FR | 2824340 | | 11/2002 |
| GB | 1 208 205 | | 10/1970 |
| GB | 2029802 | | 3/1980 |
| GB | 2078833 | | 1/1982 |
| JP | 07213159 | * | 8/1995 |
| WO | 90/12160 | | 10/1990 |
| WO | 2003/038196 | | 5/2003 |
| WO | 2005/080691 | | 9/2005 |

* cited by examiner

CELLULAR CONFINEMENT SYSTEMS

CROSS-REFERENCE TO RELATED APPLICATIONS

The present application is a continuation-in-part of U.S. application Ser. No. 12/442,756, now U.S. Pat. No. 8,425,158 which represents a National Stage application of PCT/GB2007/003630 filed Sep. 24, 2007 entitled "Cellular Confinement Systems."

BACKGROUND OF THE INVENTION

The present invention relates to cellular confinement systems, in particular to three-dimensional cellular structures designed to physically confine soil, sand or other filler materials.

Confinement systems are commonly used in civil engineering applications for land reinforcement, erosion control, embankment stabilisation, retaining structures and channel protection. For example, metal or wicker baskets called gabions which are filled with stones, earth, etc. are used in the construction industry e.g., for shoring up, slopes or forming sea defences.

Cellular confinement systems prevent horizontal movement of the confined material, substantially improving the material shear strength and bearing capacity. They can be used to four access roads, hard standings, embankment slopes, containment dykes and levees, landfill lining and covers, dam faces and spillways, noise abatement walls and parking areas. Alternatively, such cellular systems can be stacked in order to support slopes or construct walls.

In industrial applications, confinement cells are traditionally used as a lightweight filler within items to provide additional stiffness and strength. Cellular confinement structures also have military applications such as security and defence barriers.

Confinement systems formed from metal baskets are limited in their applications as the fill material must be large enough to be retained by the basket mesh. Gabions are typically filled with stone which is dressed and laid in the nature of wall so as to have an enhanced appearance when the baskets are left exposed to view. It can therefore be time consuming and labour intensive to provide a visually appealing system e.g., for shoring up an embankment adjacent to a motorway.

It has been proposed in WO 90/12160 to provide structural blocks formed by wire mesh cages which are lined with a geotextile material. By providing the cages with a fabric liner a wider variety of infill materials may be employed, such as soil and sand. However, a liner needs to be stapled in place inside each cage. The system can be transported flat and then filled locally upon demand. However, such a composite system has certain drawbacks. Several manufacturing and assembly stages are required and the material cost is relatively high. The system is also relatively bulky and heavy to transport.

For civil engineering applications there are available cellular systems such as those manufactured by Terram Ltd. which are made from various grades of thermally bonded nonwoven geotextile. Such geotextiles have the flexibility of a fabric combined with a high tensile strength and stiffness. They are water permeable so soils are prevented from intermixing while still permitting water to flow freely through the system.

A cellular textile sheet is described in U.S. Pat. No. 4,572,705 and a three-dimensional cellular geotextile is described in FR 2824340.

Geotextile cellular systems can be used to confine all kinds of aggregates, soils, sand, etc. of any particle size. They are commonly used in a single layer to help prevent erosion by confining soil on slopes. Although such cellular systems can be stacked e.g., to form an earth retention structure for embankments, there is a limit to the steepness of wall that can be achieved. This depends on the fill material and cell size as well as the skill and accuracy of placement. Often, each subsequent layer of cells must be stepped back from the layer below in order to stabilise the structure. Using rock or aggregate fill materials a short vertical wall may be possible, but where the confined material is a fine granular fill material such as soil or sand it has been found that leakage occurs between the layers when the cells are stacked vertically. The strength of the system is also dictated by the properties of the geotextile material. In some applications, additional reinforcement may be required.

The present invention seeks to mitigate the problems outlined above.

SUMMARY OF THE INVENTION

A first aspect of the invention provides a frameless cellular confinement system for soil, sand or other filler material, the system comprising subassemblies each made up of a plurality of interconnected open cells of fabric material, the sub-assemblies being stackable one on top of the other to provide a structure having at least one generally vertical side or end wall, the system further comprising sealing means which are arranged between vertically juxtaposed sub-assemblies in use to substantially prevent or minimise finer aggregate material escaping from between the stacked sub-assemblies at said generally vertical side or end wall.

By "frameless", it is meant that at least the sub-assemblies of the system are free of a wire mesh or wire cage support assembly. In other words, the cells of the cellular subassemblies are directly interconnected by the fabric material itself rather than each fabric cell being located in a respective framed enclosure. In preferred embodiments, the entire system is frameless. It is however also envisaged that the system may, for example, be deployed within some form of outer housing or framework. Such a framework may be formed of plastic or metal. Internal support struts might also be provided within the cells, though this is not preferred. Through the use of such an arrangement it has been found that it is possible to erect vertical walled structures of substantial height using a cellular fabric confinement system without the use of a wire mesh or wire cage support. The cells are "open" in that they have no top or base wall, so the filler material is vertically continuous from layer to layer through the cells of said stacked sub-assemblies, leakage of fine filler material being prevented by the sealing means. However, the top and/or bottom subassembly in the stacked system may be provided with cover means to separate the fill material from the external environment.

The sealing means may comprise zips or other fastening means, or tape, arranged along respective lower and/or upper edges of the sub-assemblies at the or each vertical wall. However, in a preferred embodiment such means comprises one or more skirt portion(s). The skirt portions are preferably flexible and/or liquid permeable, as is discussed below. Flexible skirt portions may more easily be tucked inside the cell walls of juxtaposed sub-assemblies. They may also be more conformable and will lie flat against the cell walls, whether on the inside or outside. They may also be better able to bend around cell corners.

The skirt portion or portions may, in some embodiments, be fixedly attached to or integral with the walls of respective cells of an upper one of the sub-assemblies and extend in use down into underlying cells adjacent the generally vertical side or end walls. In other embodiments, a skirt portion or portions may be fixedly attached to or integral with the walls of respective cells of each sub-assembly and may extend in use upwardly into or over overlying cells of an upper sub-assembly. In yet other embodiments, the skirt portions may extend in use both upwardly and downwardly from the walls of a respective cellular sub-assembly. As will be explained in more detail below, a skirt portion may provide a seal between one or more sets of vertically superimposed cells.

A second aspect of the invention provides a sub-assembly for a cellular confinement system for soil, sand or other filler material, the sub-assembly formed of a plurality of interconnected cells of fabric material, at least some of the cells being provided with a skirt portion extending from a respective cell wall, said skirt portion being fixedly attached to such wall.

In accordance with a third aspect of the invention there is provided a sub-assembly for a cellular confinement system for soil, sand or other filler material, the sub-assembly formed of a plurality of interconnected cells of fabric material, at least some of the cells being provided in use with a skirt portion extending from a respective cell wall, said skirt portion being formed of a separate piece of material from such wall.

In accordance with a fourth aspect of the invention there is provided a sub-assembly for a cellular confinement system for soil, sand or other filler material, the sub-assembly formed of a plurality of interconnected cells of fabric material, at least some of the cells having at least one cell wall provided with an integral skirt portion. Preferably, the fabric material of the cells and integral skirt portion is flexible.

It will be appreciated that sub-assemblies having skirt portions extending from the cell walls can form a stronger cellular confinement system than unreinforced sub-assemblies. The skirt portions can be used to guide and align the stacking of sub-assemblies of cells in several layers. Furthermore, as the extending skirt portions can overlap with the cell walls of an upper and/or lower sub-assembly in a stacked system, leakage of the filler material from between the sub-assemblies can be minimised.

As the fabric cells are interconnected with one another there is no need for additional joining means such as clips (though the use of such is not outside the scope of this invention). And, unlike a system that is made up from separate joined panels, an interconnected cellular system is substantially uniform in its structural strength without any significant points of weakness.

The sub-assemblies are advantageously manufactured into an integral cellular structure such that construction and connection of cells on-site is not required, as is the case with gabions for example.

The use of a fabric material, which is preferably a flexible fabric material, to form a sub-assembly for a cellular confinement system in accordance with the invention without a wire mesh or wire cage support structure enables it to be flexible, easy to handle and relatively light. It can be flat-packed so that it is relatively compact to transport. The system may therefore be suitable for air freight and helicopter delivery to remote areas. For example, an ISO 40 ft (12 m) container sized 12.00×2.34×2.28 m (L×W×H) can hold enough fabric to erect a filled wall 2.0 m high, 2.0 m wide, and 900 m long. The maintenance requirements can be minimal and the life expectancy of the system can be relatively long as there are no metal, timber or concrete parts which would potentially be effected by cracking, spalling, splintering or corrosion.

A flexible fabric material that is preferably also permeable to water will allow the movement of water and nutrients thereby encouraging vegetation to grow in suitable confined materials such as soil. Such vegetated systems can provide increased strength through the root structure and result in a more natural finished appearance, compatible with the local environment and ecology. The fabric material may also enable more eco-friendly disposal of subassemblies or systems in accordance with the present invention.

The cellular subassemblies can be used to form flood protection barriers. After stopping the initial flood impact, water can drain through the preferably permeable fabric material of the cells, leaving a solid protective barrier.

A subassembly or cellular confinement system in accordance with the invention can have little attenuating effect on radio or radar signals, unlike systems having metal components. The subassemblies can therefore enable the construction of substantial physical barriers without affecting communications.

Such systems may also have a reduced thermal signature for infrared detection.

Where the skirt portion is fixedly attached to the cell wall, strengthening and reinforcement of the system can be maximised. Leakage of the confined material between a cell wall and its skirt portion can be eliminated. The system can be provided to a user with the skirt portions pre-attached and ready for use, making it quicker and easier to stack layers of sub-assemblies of the cellular system.

It is preferred, at least in some embodiments, to attach the skirt portion(s) by gluing. It has been found that some hot melt glues are not appropriate for applications where the system is exposed to a wide range of ambient temperatures, e.g., in desert areas. A special adhesive is therefore preferred.

In other embodiments, the skirt portion may be attached by stitching. This may be preferred where the material of the cells and/or skirt portions do not take well to adhesive. Of course, the skirt portions may be both glued and sewn if desired.

The skirt portions may be fixedly attached, either in advance or on site, by any convenient method including one or more of stitching, stapling, riveting, taping, gluing, hot welding, ultrasonic welding, etc. The preferred fixing method may depend on the respective materials of the cells and skirt portions. Many different methods of attachment are suitable as the location of the skirt portions is not particularly load bearing and the method of attachment is merely to hold the skirt portions in place and to prevent fill material from creeping between the skirt portions and the cell wall to which they are attached.

In one preferred embodiment, the skirt portion(s) preferably comprise a skirting strip which is wrapped around at least part of the upper and/or lower perimeter of a first cellular subassembly. The skirting strip may be attached, e.g., by gluing or stitching, to the first cellular subassembly. When a second subassembly is stacked above or below the first, the skirting strip will overlap the two superimposed subassemblies but due to its length it may tend to gape. The skirting strip is preferably tacked onto the second subassembly so as to prevent it from gaping. This may be important where the skirting strip extends from an upper perimeter and needs to be kept standing vertical. Fastening the skirting strip to both upper and lower subassemblies may also help to strengthen the stacked system and reduce the risk of leakage. Such fastening may therefore be used with any skirt portions, whether a strip or otherwise, and whether overlapping on the inside or outside of the cell walls.

Conventional metal rivets, studs, staples, or similar fasteners may be used. However, it has been appreciated that metal fasteners are prone to corrosion and may not be suitable in some environments. They may also interfere with communications and could result in shrapnel if the cellular system is subjected to a blast. Thus in preferred embodiments, the skirt portion(s) are fixed or attached to a cellular subassembly by plastic fasteners.

This feature is considered to be novel and inventive in its own right and thus from a further aspect the present invention provides a cellular confinement system for soil, sand or other filler material, the system comprising subassemblies each made up of a plurality of interconnected open cells of fabric material, the subassemblies being stackable one on top of the other, the system further comprising one or more skirt portion(s) which are arranged between vertically juxtaposed sub-assemblies in use to substantially prevent or minimise finer aggregate material escaping from between the stacked sub-assemblies, wherein the skirt portion(s) are fixed to at least one subassembly by plastic fasteners.

The fasteners are preferably self-holding, e.g., barbed plastic push-fasteners, plugs or studs. The fasteners themselves may be sharp so as to assist in penetration of the fabric material. Holes for the fasteners could be pre-formed in the material, but this would require alignment of holes in the skirt portions with holes in the walls. It is therefore preferred that a pilot hole is made in the fabric material layers as required e.g., using an appropriate puncturing tool. Of course, the plastic fasteners may be used alone or in conjunction with other fixing methods as described above.

A further advantage of the plastic fasteners is that they can be used to patch-repair a damaged cell wall. For example, where a cell wall has been breached or torn, the plastic fasteners can be used to tack a patch of fabric over the hole. From a yet further aspect the present invention provides a sub-assembly for a cellular confinement system for soil, sand or other filler material, the sub-assembly formed of a plurality of interconnected cells of fabric material, one or more of the cells being provided with a piece of fabric material fixed to the subassembly by one or more plastic fastener(s).

The piece of fabric material may form a seal against the escape of filler material from the subassembly. For example, the piece of material may comprise a patch. In other embodiments, the piece of fabric material may form a reinforcing layer. In other embodiments, the piece of fabric material may comprise a skirt portion. In all embodiments, it is preferable that the piece of material is the same fabric material as the cells.

A yet further advantage of the plastic fasteners is that they can be used to attach together the walls and corners of sub-assemblies laid out side-by-side or otherwise tessellated in a layer. From a yet further aspect the present invention provides a cellular confinement system for soil, sand or other filler material, the system comprising subassemblies each made up of a plurality of interconnected open cells of fabric material, the subassemblies being stacked side-by-side in a layer with plastic fasteners joining together the walls of respective cells in adjacent subassemblies.

Where the skirt portion is formed of a separate piece of material from the cell walls, in accordance with the third aspect of the invention, the skirt portions can be selectively added to the system wherever reinforcement is required, for example at an outer perimeter. The separate skirt portions may be fixedly attached to the cells or removably retained therein. A user can therefore build his own confinement structure using a number of cellular sub-assemblies side-by-side and/or stacked on top of one another and choose the cells to which to add skirt portions. The skirt portions can be removed and reused as desired, especially where certain cells are damaged or where cells are removed to change the dimensions of the system. Where a skirt portion is found to have been damaged, it can be removed and replaced before filling or re-filling the system.

When forming a barrier structure, the skirt portions may be used to provide selective reinforcement of the cells. This can be advantageous when forming a crash barrier or ballistic defence. In one preferred embodiment, the skirt portion(s) may be provided by an inner layer fitted inside selected cells of a subassembly. The cells therefore comprise a double layer of material. Preferably, at least the outer perimeter cells of a system are provided with the inner layer. The inner layer preferably protrudes from the top and/or bottom of the cells to provide the seal between stacked layers. In a stacked system, it may not be necessary for every subassembly layer to have protruding skirt portions. For example, if alternate subassemblies are provided with an inner layer which protrudes both top and bottom, then the subassemblies in between may be provided with an inner layer which fits between the skirt portions and merely acts as reinforcement.

From a further aspect, the present invention provides a sub-assembly for a cellular confinement system for soil, sand or other filler material, the sub-assembly formed of a plurality of interconnected cells of fabric material, at least some of the cells being provided in use with an inner layer formed of a separate piece of material from the cells. The inner layer may be formed of the same material as the cell walls or of a different material. For example, the inner layer may be formed of a stiffer material for reinforcing purposes.

Preferably, the inner layer is fixedly attached to the cell walls, for example by gluing or stitching. This is particularly preferred when the inner layer provides a skirt portion or portions. In some embodiments, a reinforcing sheet or plate may be slid between the inner layer and an adjacent cell wall. The reinforcing sheet may be retained in the pocket formed between the inner layer and an adjacent cell wall of the same subassembly layer. In some embodiments, the reinforcing sheet is preferably held between the skirt portion of a cell of a first subassembly and the adjacent cell wall of a vertically juxtaposed second subassembly. The skirt portion may be provided by an inner layer or may be otherwise formed, as described hereinabove.

The reinforcing sheet may be formed of metal (e.g. steel), plastic, ceramic, or a fibre reinforced material. Aramid fibres may be used to give ballistic rated protection.

The Applicants have appreciated that instead of using a full inner layer, only certain of the cell walls in a cellular subassembly may be provided with a double layer of fabric. The double layer can itself provide selective reinforcement of the structure, for example at the perimeter walls. Thus when viewed from a further aspect the present invention provides a sub-assembly for a cellular confinement system for soil, sand or other filler material, the sub-assembly formed of a plurality of interconnected cells of fabric material, at least some of the cells comprising a wall formed of two layers of the fabric material. Preferably, a pocket is formed between the two layers and further preferably a reinforcing sheet or plate as above may be held in the pocket.

Where the skirt portion is formed integrally with a cell wall, in accordance with the fourth aspect of the invention, no extra assembly steps are required. The system can be provided as a one-piece unit. As the skirt portion is an integral part of the system, it cannot be unattached other than by breaking the fabric of the cells.

Certain of the cell walls may be provided with an extending flap of material which can then be folded into the cell to at least partially separate the confined material in stacked layers and prevent it from leaking out. Folding of the skirt portion is possible due to the flexibility of the fabric material and provides a distinct advantage over cellular structures made from stiffer materials such as plastic or metal. Alternatively, the extending flap can be tucked against an adjacent cell wall, either on the inside or outside. The extending flap may be held against the wall of a superimposed subassembly by plastic fasteners, as is described above.

It has been appreciated that by using flexible fabric skirt portions the skirt portions can be used to close the top or bottom of a subassembly, for example, when it forms the upper or lower layer of stacked system. In some embodiments, the cells of a subassembly may be provided with a skirt portion, whether a separate piece of retained material, a fixedly attached skirt portion or an integral skirt portion, which is able to fold down to close the top and/or bottom of the open cells. The skirt portion may comprise eyelets for receiving a drawstring in use, such that preferably the cells can be fastened closed by drawing together the skirt portions. Closure of the cells may be effected at either the top or bottom or both, to capture the fill material and to delay the escape of fill material in the event of impact, for example when a stacked system is used as a crash barrier or defence.

Additionally or alternatively, at least some skirt portions, e.g., at the perimeter of a subassembly or along an end wall, preferably comprise eyelets to facilitate fastening of adjacent subassemblies.

The skirt portions may be folded and/or attached over a framework where one is provided. They may also be folded and/or attached against an adjacent structure to help tether the system in place.

In accordance with all of the above-described aspects of the invention, the Applicants have realised that by providing a skirt portion which can extend substantially parallel to the cell walls and which will overlap with the cell walls of an adjacent sub-assembly in a stacked structure, it is possible to stack the fabric cell sub-assemblies directly one on top of the other and form a substantially vertical wall without the use of a wire mesh or wire cage support structure. This can be important for forming unclimbable defensive barriers and high walls which are not possible with known geotextile cellular systems. Vertical walls up to 10 m high can be built. Walls of any thickness and length can be produced to suit ballistic and vehicle impact requirements. Such a method of stacking a cellular confinement system is considered to be novel and inventive in its own right and thus when viewed from a further aspect the invention provides a method of forming a cellular confinement system for soil, sand or other filler material comprising providing a plurality of sub-assemblies of interconnected cells formed from a fabric material, providing at least some of the cells with a skirt portion and stacking the sub-assemblies such that the skirt portion extends between the cell walls in one of the sub-assemblies and the cell walls in another of the sub-assemblies.

A further aspect of the invention provides a method of assembling a barrier structure comprising providing a plurality of frameless sub-assemblies each formed of interconnected fabric cells, introducing filler material into the cells of a first sub-assembly laid on the ground, positioning a second sub-assembly on top of the first so that respective perimeters of the sub-assemblies align to provide a substantially vertical wall, forming a seal against escape of finer filler material between the sub-assemblies along the vertical wall, introducing filler material into the second sub-assembly, and repeating the above steps with further sub-assemblies stacked on top of the first and second to provide a vertical walled barrier structure of desired height. Of course, just two subassemblies may be required to form a barrier of the desired height.

It will be appreciated that in accordance with the invention a confinement system or barrier structure can be quickly assembled on the spot with minimal manpower and equipment required. A structure so formed can be filled with any locally available compactable material. For example, a wall 2.0 m high, 2.0 m wide and 10 m long can be completed in 1 hour using a four man crew and a fill-tipping bulldozer. Where sand is the confined material, no compaction is necessary to produce a stable 2.0 m high structure.

Preferably, skirt portions are used in at least one of the sub-assemblies to form the seal. The skirt portions may be either fixedly attached to the cell walls, formed of a separate piece of material and removably retained in the cells, or integrally provided by the cells. The respective advantages of these constructions have been discussed above.

The stacking and filling method can be adapted depending on the type of barrier structure required. Subassemblies may be stacked side-by-side as well as on top of one another. The overall size and shape of the barrier structure may therefore be tailored on site as required. Furthermore, the Applicants have appreciated that the cellular structure of the subassemblies advantageously allows a variety of different fill materials to be used within the same confinement system. Different fill materials can occupy different cells in each subassembly. This can lead to a vertical layering effect in terms of the fill material, giving the system selective barrier properties. For example, a more pliant fill material may be used in the front/outer or middle layers of cells with a more compact material such as sand in the back/inner layers of cells. In another example, stone may be used as the fill material in the front or outer layers, followed by air-filled cells, followed by sand in the back or inner layers. Different layering arrangements of fill materials may be selected so as to dissipate the energy of certain types of weapons. The layering of the fill materials may also be used in conjunction with selection of those cells provided with skirt portions. For instance, the outer cells around the perimeter of a system may be provided with interlocking skirt portions to give a more rigid shell whilst the innermost cells may not have any skirt portions and can act to absorb any impact.

From a further aspect, the present invention provides a method of assembling a barrier structure comprising providing a plurality of cellular sub-assemblies each formed of interconnected fabric cells, introducing a first fill material into select ones of the cells of a first sub-assembly laid on the ground, introducing a second, different fill material into select other ones of the cells of the first sub-assembly, positioning a second sub-assembly on top of the first sub-assembly, introducing the same fill materials into corresponding cells of the second sub-assembly, and repeating the above steps as required with further sub-assemblies stacked on top of the first and second to provide a barrier structure of desired height. Of course, any number of different fill materials may be used in different sections of the cellular structure. The fill materials may also be varied both within a horizontal layer and a vertical layer. For example, lower layers could be filled with sand whilst upper layers are filled with a coarser material such as stone.

Some general features will now be described in accordance with all aspects of the invention. The sealing means, preferably comprising one or more skirt portions, may be provided on any number of the cells and associated with as many of the cell walls as desired. The seal may be formed at the inner or outer surface of the cell walls. A skirt portion extending around the whole perimeter of each cell e.g., a skirt ring or tube may be used for a maximal strengthening effect. At least in some preferred embodiments, therefore, the skirt portion is shaped to match the inner perimeter of a cell. Such skirt rings or tubes can be advantageously used to help open out the cellular structure and hold it in tension for filling.

In other preferred embodiments, the sealing means, preferably comprising one or more skirt portions, does not extend around the whole perimeter of the cells. This can make it easier to insert the skirt portions into the cells or wrap them around the cell walls and possibly attach them to the cell walls. Where a separate skirt portion is provided per selected cell, the skirt portion may just extend across the width of each perimeter cell wall, e.g., a linear strip, however it is preferred that the skirt portion extends across the width of a perimeter cell wall and at least partly across an adjacent cell wall, e.g., a U-shaped strip. This can help to ensure that the skirt portion seals the corners between adjacent cells where leakage could otherwise occur. It also helps to strengthen the system while minimising material costs.

The greater the number of cells with sealing means or skirt portions, the greater the overall strength and impact resistance of the structure. By providing each cell with a skirt portion the cells can be guided into exact alignment with each other when being stacked.

However, in some embodiments it is preferred that only the cells at the perimeter of a sub-assembly are provided with sealing means or skirt portions. The sealing means or skirt portions can be used at the perimeter to provide the strength and leakage control needed to enable vertical stacking of the sub-assemblies. It may be easier to stack the subassemblies when the inner cells are free of skirt portions and exact alignment is not required across the whole system.

One advantage of being able to limit the skirt sections or portions to the perimeter only of the cell structure is that polymeric geogrids can be introduced at one or more horizontal layers between the cells to provide additional strength for the construction of particularly high structures.

It is further preferred that only the perimeter cell walls of the perimeter cells are provided with skirt portions. This can optimise the strength, stackability and leakage control of the system while minimising the material and manufacturing costs involved in adding the skirt portions.

A skirt portion may be associated with a number of cells in the system. For example, a skirt portion may take the form of a strip running along several perimeter cell walls. This could be achieved by attaching the strip to the fabric material before forming the interconnected cell structure, or by using a slotted strip which can be fitted inside a number of adjacent cells. Where the skirt portion is integral, the number of the cells having a skirt portion can be selected during manufacture of the cellular system, e.g., those cells intended to form the perimeter of the sub-assembly could be provided with a skirt portion.

In some embodiments, each subassembly of interconnected cells may have a skirting strip fixedly attached around the outer perimeter of the subassembly, e.g., at the top and/or bottom of the subassembly. One such embodiment has already been described above. A continuous band of skirting material wrapping around the perimeter can provide additional strength and integrity to the structure. The skirting strip may be made of the same or different material as the cell walls. Where several sub-assemblies are provided side-by-side in a layer, the skirting strips can help to strength the system by providing reinforcement.

This feature is considered novel and inventive in its own right and thus when viewed from a further aspect the present invention provides a sub-assembly for a cellular confinement system for soil, sand or other filler material, the sub-assembly formed of a plurality of interconnected cells of fabric material, the sub-assembly being provided in use with a skirting strip around the perimeter cell walls.

The skirting strip may extend downwardly from subassemblies used in upper layers. However, it has been found simpler at least in some embodiments for all of the subassemblies to have an upwardly extending skirting strip so that the subassemblies can be used equally in the lowermost and upper layers in a stacked system. The skirting strip may be tucked inside the cell walls of an upper layer. Alternatively, the skirting strip may overlap and cover the external boundary between a lower and an upper layer. Such an external skirt portion may be preferred where the skirt portion is made of a less flexible material which cannot be easily tucked inside adjacent cells but is stiff enough to remain in a vertical position covering the boundary between layers. Fasteners such as plastic rivets may be used to fix the upstanding skirting strip against an upper layer, as has been described above.

In order to maximise the potential for tailoring the cellular system depending on its application, it is preferable in some embodiments that each skirt portion is associated with a single cell. The basic cellular system can therefore be manufactured according to known principles. Starting from a standard cellular system formed of a plurality of interconnected cells of fabric material, the number of cells requiring skirt portions can be determined on a case-by-case basis. For example, where a single cellular sub-assembly is stacked on top of one or more other sub-assemblies to form a wall, skirt portions may be added to the perimeter cells all the way around the sub-assembly. Where two or more sub-assemblies are intended to be placed side-by-side in a larger structure then only those cells which will form the perimeter of the structure as a whole may require skirt portions.

In some embodiments, it is preferred that the skirt portions are formed of the same fabric material as the cells. Where the skirt portions are attached to the cell walls this can help to ensure that the joining method is equally effective on the like parts. It can also ensure that the system responds uniformly to environmental conditions and, where the fabric is porous, water can be released through the whole system. Furthermore, the skirt portions will not contribute disproportionately to the weight of the sub-assembly.

In preferred embodiments, the skirt portion is made of a fabric material which is preferably flexible, but in some embodiments it is preferred that the skirt portion is formed of a stronger and/or stiffer fabric material to the cell walls. In other embodiments, the skirt portions can be made of any suitable material, in particular a stiff material, to provide additional strengthening and prevention of fill material leakage. The skirt portion(s) can act to strengthen the cellular confinement system and are always such that they prevent or minimise the escape of fill material from between subassemblies. Where the skirt portions are formed of the same fabric material, preferably a flexible fabric material, as the cell walls, additional reinforcement may be provided by inner layers formed of a different material and/or strengthening plates between the skirt portions and adjacent cell walls. Such features are described hereinabove.

The cells may be formed of any suitable fabric material exhibiting strength and flexibility, including woven, knitted and nonwoven fibrous webs. The fabric preferably comprises a nonwoven material, further preferably a flexible nonwoven material. Such materials are often chosen for their durability. It is further preferred that the nonwoven is polypropylene-based. A particularly preferred material is a non-woven fabric from bi-component fibres, e.g., Terram 4000 (335 gsm) or other geotextiles manufactured by Terram Limited. One such suitable material comprises 70% polypropylene and 30% polyethylene. These materials have very good tensile strength, stiffness, puncture resistance and tear resistance, combined with flexibility. They may also be permeable to liquid.

Suitable fabric materials include spunbonded polypropylene nonwovens and other nonwoven and woven materials. Another example of a preferred material is Terram 400 gsm thermally bonded nonwoven.

Another example of a suitable nonwoven geotextile material is Typar® 3100 available from Fiberweb Inc. in the USA. This flexible fabric material has a basis weight of 10 osy (approx. 340 gsm) (as measured according to ASTM D5261) but is thinner than similar Terram geotextiles, being only 28 mils (0.71 mm) thick (as measured according to ASTM D1777).

In a preferred embodiment, the interconnected cells are formed from a continuous strip of nonwoven material which is folded back and forth on itself, the folded layers being bonded to each other at spaced apart locations such that the material can be opened out into a cellular sub-assembly. Preferably, the cells are formed by applying an adhesive between the folded layers. Joints formed in this way have been found to be as strong as the nonwoven material itself. A special adhesive is preferred which can retain its bonding strength across a wide temperature range including extreme cold and extreme heat as found in some countries of the world. Otherwise, the cells can be formed by sewing the folded layers together at spaced apart locations. The stitched joints can be strong and long-lasting. Alternative techniques may include thermal lamination or ultrasonic welding.

It will be appreciated that an integral skirting strip around the perimeter cell walls may be created by varying the width of the strip of material that is used to form the cellular structure. Those parts of the strip that will form a cell wall at the perimeter of a sub-assembly may be e.g., 100 mm wider than other parts of the strip that will form cell walls inside the sub-assembly. When the strip is folded back and forth on itself and bonded to form the cells, the wider parts of the strip form the perimeter of the sub-assembly and therefore provide integral skirt portion.

A disadvantage of sub-assemblies which are formed from a folded strip is that the ends of the strip must be removed or glued down or sewn down. In other embodiments, the interconnected cells are manufactured instead in discrete subassembly sections, each section comprising e.g., 12 interconnected cells. This can make it easier to attach an external skirt portion around the perimeter of the subassembly section. For example, when the cellular subassembly is not formed from a continuous length of fabric then an integral skirt portion may be formed around the perimeter of a cellular section by forming the perimeter cell walls from a wider piece of fabric.

The interconnected cells may be manufactured so as to have any suitable shape such as triangular, rectangular or diamond-shaped, etc.

Where a cellular sub-assembly is formed from a continuous strip of nonwoven e.g., geotextile material which is folded back and forth on itself and bonded together at spaced apart locations, the resultant cells tend to be rectangular or diamond-shaped. Around the perimeter of the sub-assembly, each cell has two walls exposed. The cells tend to bulge outwardly when they are filled with material, resulting in a rounded appearance. The outer perimeter therefore forms a wall that is not flat but corrugated. This means that the width of the sub-assembly is not constant along its length. An effective width may be defined to take into account the corrugated outer perimeter. When such sub-assemblies are stacked to form a barrier structure, for example, the effective width may be chosen to provide a desired degree of protection while the structure may have a wider footprint on the ground.

As is mentioned above, in other embodiments the interconnected cells may be manufactured in one or more discrete sub-assembly sections with a separate strip wrapped around the section(s) to form the outer perimeter of the sub-assembly. The separate strip may be wider than the sub-assembly section(s) so as to form an integral skirt portion around the perimeter of the cellular section(s). An advantage of this manufacturing technique is that the strip forming the outer perimeter can be pulled tight between spaced apart locations where it is bonded (e.g., by adhesive or stitched joints) to the internal cellular section(s) so that each of the outer cells is triangular, rather than rectangular or diamond-shaped, with a single exposed wall. The outer cell walls therefore do not tend to bulge when filled with material. As a result, the outer perimeter of the sub-assembly forms a wall that is flat rather than corrugated.

This is considered novel and inventive in its own right, and thus when viewed from a further aspect the present invention provides a sub-assembly for a cellular confinement system for soil, sand or other filler material, the sub-assembly formed of a plurality of interconnected cells of fabric material manufactured in at least one discrete cellular section, and comprising a wider piece of fabric around the perimeter of the cellular section to form the perimeter cell walls with an integral skirt portion.

It will be appreciated that such a sub-assembly can have a substantially constant width when it is opened out and filled with aggregate material, because the separate piece of fabric around the perimeter can form a flat wall rather than one that is corrugated. The cellular structure of the discrete sub-assembly section(s) is effectively masked by the perimeter walls. This can be particularly beneficial when multiple sub-assemblies are stacked one on top of the other to provide a confinement system or barrier structure having generally vertical side or end walls. The vertical walls are substantially planar rather than corrugated, resulting in a system that has a generally rectangular footprint with a constant width along its length. The invention therefore extends to a barrier structure comprising a plurality of sub-assemblies stacked one on top of another to provide a barrier structure of desired height, wherein each sub-assembly is formed of a plurality of interconnected cells of fabric material manufactured in at least one discrete cellular section, and comprises a wider piece of fabric around the perimeter of the cellular section to form the perimeter cell walls with an integral skirt portion. The skirt portion preferably extends between vertically juxtaposed sub-assemblies to substantially prevent or minimise finer aggregate material escaping from between the stacked sub-assemblies at the outer perimeter of the structure.

In one set of embodiments, the interconnected cells of the discrete cellular section(s) may be rectangular or diamond-shaped, while preferably the cells around the perimeter are triangular in shape. The wider piece of fabric around the perimeter of the cellular section(s) can define the triangular cells. Preferably, the wider piece of fabric is a continuous strip of nonwoven e.g., geotextile material which wraps around the outer perimeter of the sub-assembly. A continuous strip of material is preferred to impart strength.

In another set of embodiments, all of the interconnected cells of a sub-assembly may be manufactured so as to have a triangular shape. Such a sub-assembly may be manufactured from one or more strips of nonwoven e.g., geotextile material which is/are folded back and forth in the form of a zig-zag. Instead of the folded layers being bonded to each other at spaced apart locations, at the folds of the zig-zag they are bonded to a wider piece of fabric that extends around the perimeter of the sub-assembly. Each cell is therefore triangular, with two internal walls formed from the zig-zag strip and a perimeter wall between the folds of the zig-zag strip formed by the wider piece of fabric. The perimeter cell walls have an integral skirt portion.

This is considered novel and inventive in its own right, regardless of whether or not a skirt portion is provided, and thus when viewed from a yet further aspect the present invention provides a sub-assembly for a cellular confinement system for soil, sand or other filler material, the sub-assembly formed of a plurality of interconnected open cells of flexible fabric material having a generally triangular shape.

An advantage of forming a cellular sub-assembly from triangular cells is that there is a higher ratio of fabric material per volume of each cell. This can make the structure stronger and more suitable for building defensive barriers and the like.

The fabric material may be treated either during or post manufacture to improve certain properties and/or appearance. For example, where the system may undergo prolonged exposure to sunlight the UV resistance of the fabric may be enhanced by adding appropriate stabilisers. Once a cellular sub-assembly has been assembled into a structure and filled the outside surface can be treated on location to give it any appearance which blends into its surroundings or to enhance its resilience. The fabric may be coloured or covered in shrouding for camouflage purposes. The fabric may also be treated so as to be radar detectable.

Cellular sub-assemblies, confinement systems and barrier structures in accordance with the invention are suitable for confining any solid particulate material such as concrete, aggregate, ballast materials (e.g., brick, broken concrete, granite, limestone, sandstone, shingle, slag and stone), crushed rock, gravel, sand, clay, peat, soil, or any other convenient aggregate material e.g., snow or ice-bound aggregate. The invention has been found to be particularly beneficial for confining sand as the seal or skirt portions can provide the strength required for a dense fill and help prevent leakage of the fine particles. Even wind-blown or dune sand, generally considered unsuitable for construction, can be used.

The sub-assemblies can be made on any macroscopic scale, although the invention has been found to apply in particular to sub-assemblies having cell dimensions of the order 100-500 mm in diameter. The cells can be of any suitable shape and are preferably circular or polygonal in cross-section. In a preferred embodiment, the cells are 500 mm in diameter and 500-750 mm deep. With cells of this size a sub-assembly can provide a high degree of confinement and improved shear strength, while still allowing for a human-sized structure to be built relatively quickly using only a few layers of cells. Furthermore, it is apparent that even if one of the cells in a sub-assembly should be damaged or ruptured in some way, the amount of confined material lost can be relatively small compared to the system as a whole and the effect on the system's strength can also be minimal as the inner cells remain intact. Where ballistics are involved, the fabric sub-assembly also has the advantage that it will not create metal shrapnel if hit.

BRIEF DESCRIPTION OF THE DRAWINGS

Some preferred embodiments of the present invention will now be described, by way of example only, and with reference to the accompanying drawings in which.

DETAILED DESCRIPTION OF THE INVENTION

Figure 1A:
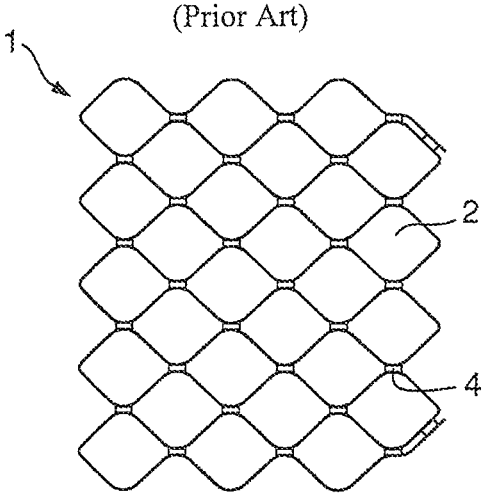
Fig. 1a (Prior Art)
FIG. 1*a* shows a schematic plan view of a prior art cellular confinement system.
Figure 1B:
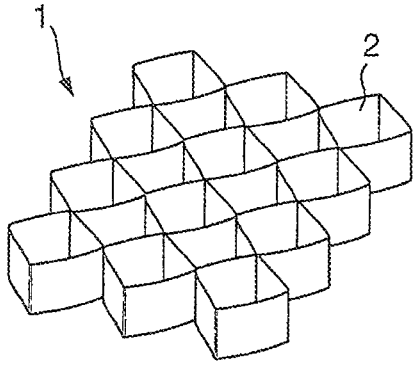
Fig. 1b (Prior Art)
FIG. 1*b* shows a schematic perspective view of the system of FIG. 1*a;*

There is shown in FIGS. 1*a* and 1*b* a prior art three-dimensional cellular confinement system 1 comprising a number of interconnected cells 2 formed from a fabric material such as a nonwoven geotextile available from Terram Ltd. The cellular structure is formed by taking a 25 cm wide strip of nonwoven and folding it back and forth onto itself. Before each fold, adhesive is applied at a number of spaced apart locations 4 along the strip. The resultant pleated stack is then openable into a three-dimensional panel 1 having cells 2 formed by the folded layers between the adhesive locations 4. Adhesive joints formed in this way have been found to be up to 85% as strong as the nonwoven material itself. A special adhesive is preferred which can retain its bonding strength across a wide temperature range.

The resultant cellular system shown in FIG. 1*b* comprises a 3×4 array of cells 2 having dimensions of 25×25×25 cm. For civil engineering applications such as erosion protection the cell diameter is typically 25-45 cm and the cell depth is typically 10-15 cm. For example, the Erocell 25 product manufactured by Terram Ltd. is available in a panel measuring 10 m×7 m and containing around 1900 cells sized 25×25×10 cm. The flexible panel is collapsed into a flat state and rolled up for ease of delivery. Upon arrival at the site, the panel is expanded and may be anchored. The panel may be pinned out on the installation surface to retain the open cell shape and size before filling. On slopes, the panel is pinned down at every single cell around the perimeter and at staggered 1 m intervals across the centre of the panel.

Once the panel has been fixed and anchored in place, filling is carried out e.g., using a bulldozer to deposit soil, sand or other filler material as required. The cellular system confines the fill material within its strong geotextile cells. In soil stabilisation applications, the cell structure restricts down-slope migration and provides erosion control. When filled with sands or granular fills, the cellular structure acts like a semi-rigid 'slab' distributing loads laterally, stabilising base materials, reducing subgrade contact pressures and minimising surface rutting. It also prevents the lateral displacement of infill and reduces vertical deflections even on low-strength subgrades. Geotextile cellular systems offer improvements over conventional stabilisation materials such as concrete and aggregate by confining the infill material in the strong cells while assuring effective subgrade drainage through the porous fabric. Such systems allow for vegetative growth which provides increased strength through the root structure and results in a more natural and environmentally-friendly result.

Figure 2:
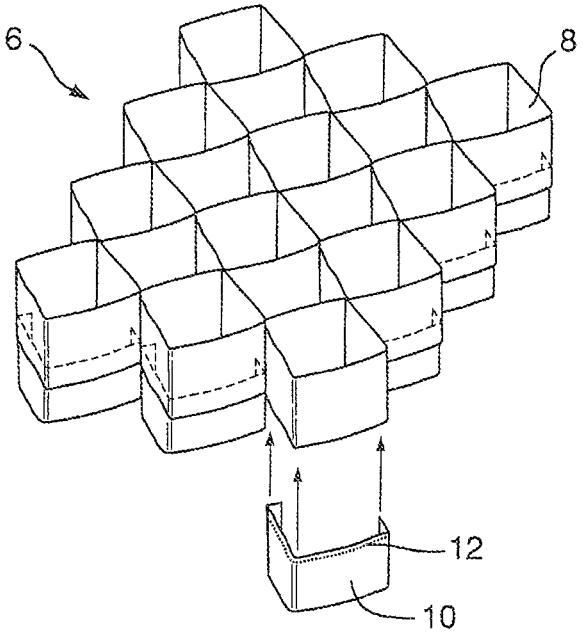
FIG. 2 shows a schematic perspective view of a cellular confinement sub-assembly in accordance with an embodiment of the present invention.

With reference to FIG. 2, a cellular confinement structure in accordance with an embodiment of the present invention comprises a sub-assembly 6 of interconnected cells 8 of a geotextile material such as is available from Terram Limited. In the embodiment shown, those cells 8 at the perimeter of the sub-assembly 6 are provided with a skirt band 10. The skirt band 10 is a strip formed of the same geotextile which has been cut to size to fit inside the cells. Each band 10 wraps around the interior surface of the cell walls, extending across those cell walls at the perimeter of the sub-assembly and partly extending across those cell walls at the interior of the sub-assembly. The band 10 is slotted in so as to partially overlap with the cell walls but is left to extend beyond the bottom of the cell so as to form an extending skirt. The cells are 50 cm deep while the skirt band is 15 cm deep, 6 cm of which is inserted into the cells to overlap with the cell walls and 9 cm of which is left protruding.

The skirt bands 10 help to guide and align the cells when stacking the sub-assemblies in several layers. They will extend into the cells of a lower sub-assembly and overlap with the cell walls of both sub-assemblies thereby preventing filler material from leaking out between the sub-assemblies.

The skirt band 10 may simply be slotted inside the cells 8. Although the material is flexible enough to bend the band 10 into the desired shape, it also sufficiently stiff that the band 10 will hold its shape and sit in the desired position inside the cell walls. Alternatively, the bands 10 may be fixedly attached to the cells 8 by stitching or gluing along the line 12 shown. The line 12 is located about 1 cm down from the top of the skirt band 10. Gluing is a convenient fixing method and by using a special strong adhesive the joint between the skirt and the cell wall can be up to 85% as strong as the geotextile material from which they are made. Such adhesives have been found to retain their fixing strength across a wide range of temperatures.

One advantage of this embodiment is that the sub-assembly including any attached skirt strips is completely collapsible and can be transported flat. Large sub-assemblies can be collapsed and rolled up. The sub-assemblies are therefore very compact which aids transportation, and relatively light as they contain only geotextile. That said, when the sub-assemblies are opened out they form very stiff, strong structures.

Figure 3A:
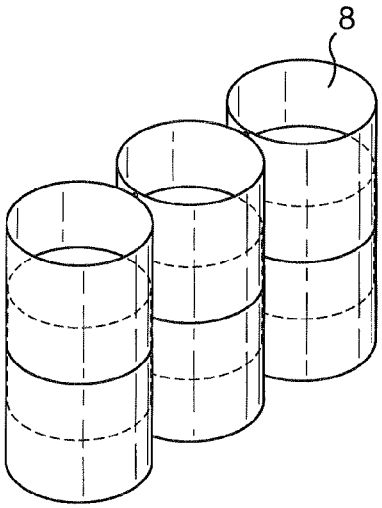
FIG. 3*a* shows a schematic perspective view of two stacked cellular confinement sub-assemblies in accordance with an alternative embodiment of the present invention and FIG. 3*b* shows an exploded view of the two stacked sub-assemblies of FIG. 3*a;*
Figure 3B:
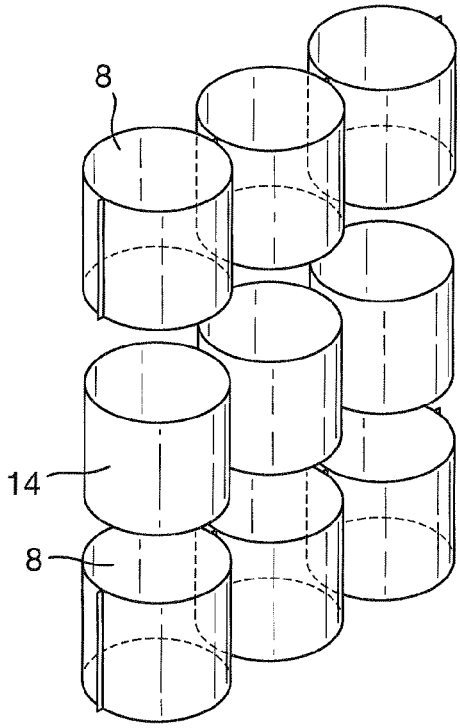

In the embodiment shown in FIGS. 3*a* and 3*b*, the interconnected cells 8 are provided with skirt rings 14 which fit inside the cells and which are sized to fit snugly against the cell walls. The skirt rings 14 can be formed from a strip of the same geotextile as the cells 8, bent into the annular or polygonal perimeter shape of the cells and optionally fixed end-to-end. Alternatively, the skirt ring 14 can be formed from a different material such as a stiff plastic, e.g., HDPE or PVC, for reinforcement purposes. Such a ring may be pre-moulded to match the size and shape of the cells. The complete skirt ring 14 has the benefit of holding each cell open and helping to tension the sub-assembly ready for filling. It guides the cells into alignment for stacking and is less likely to be accidentally folded down, which would impede filling.

Figure 4A:
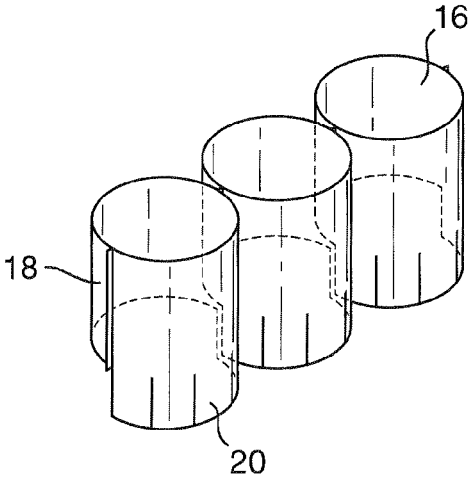
FIGS. 4*a* and 4*b* set forth schematic perspective views of a cellular confinement sub-assembly in accordance with another alternative embodiment of the present invention.
Figure 4B:
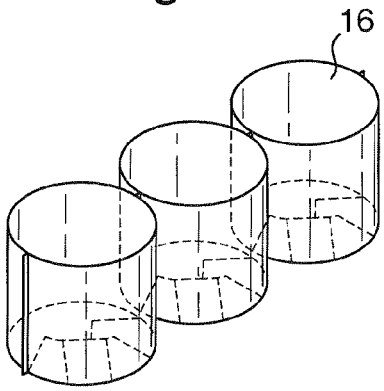

Rather than a separate skirt band or ring being retained in or attached to the cells, the cell walls themselves may provide a skirting. In the modified embodiment shown schematically in FIG. 4*a*, the perimeter cells 16 of a sub-assembly are provided with split wall dimensions. The interconnected cells are made from nonwoven geotextile as previously described. The inwardly-facing half of a perimeter cell 18 is of a standard depth matching the other cells in the system (not shown). The outwardly-facing half of a perimeter cell 18 has an extended wall 20 which is deeper than standard. As is seen from FIG. 4*b*, the wall extension 20 can be folded into the cell 16 to provide a barrier between stacked sub-assemblies and to prevent filler material from leaking out. This embodiment can only be achieved as a result of the flexibility of the geotextile material.

Figure 5:
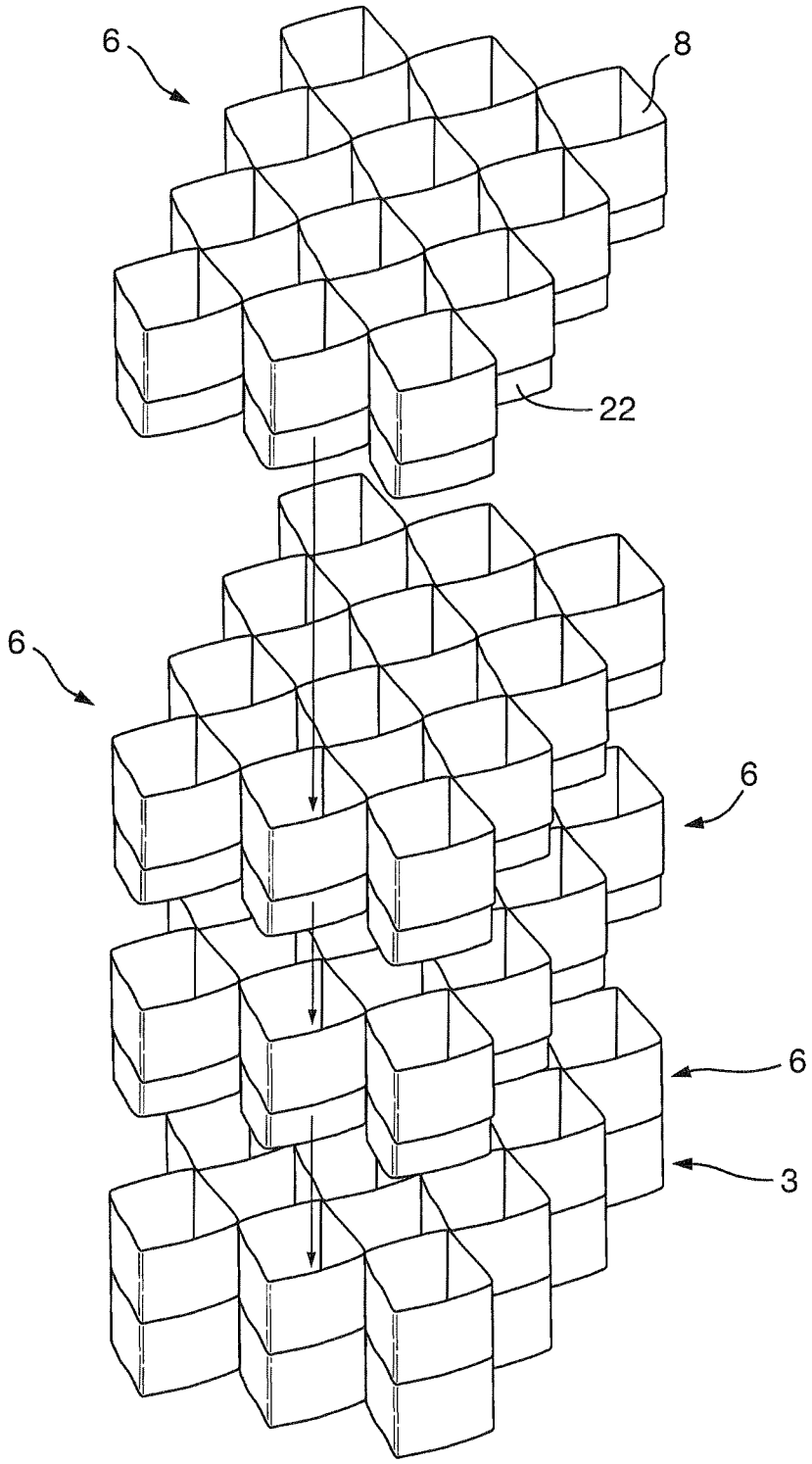
FIG. 5 shows a stacked structure formed from several of the sub-assemblies of FIG. 2.

Some methods of making cellular confinement systems and barrier structures will now be described with reference to FIGS. 5 and 6. The stacking of several sub-assemblies 6 is shown in FIG. 5. The base layer 3 is a standard cellular panel not having any skirt portions. On top of the base layer 3 there are stacked a number of sub-assemblies 6. The outer perimeter cells 8 in each sub-assembly 6 have a downwardly extending skirt 22 which overlaps with the cell walls in the vertically juxtaposed sub-assemblies to form a seal which prevents fine filler materials such as sand escaping from between the stacked sub-assemblies 6. The skirts 22 may partially or completely extend around the inside perimeter of the cells 8. The skirts 22 may be fixedly attached to the cell walls, e.g., by gluing, sewing or using plastic fasteners (described in more detail below). The protruding skirt 22 of each subsequent sub-assembly is used to guide the stacking. The skirts 22 are nested inside the cells above and below so as to cover and seal the boundary between sub-assemblies.

Each sub-assembly layer is filled before stacking the next layer. Starting from the bottom, the base panel 3 is laid out on the ground and filled up to a level about 10 cm from the top of the cells. This leaves room for the 9 cm long skirts 22 on the sub-assembly 6 which is stacked on top to fit down into the cells below. The sub-assembly 6 is positioned on top of the base panel 3 with the guidance of the skirts 22. The next fill tops off the base layer and fills the first sub-assembly 6 to a level about 10 cm from the top. The stacking and filling is repeated with further sub-assemblies 6 until the structure has reached the desired height. The uppermost sub-assembly is completely filled to the brim.

The stiffening effect of the skirts 22 allows the sub-assemblies 6 to be stacked directly on top of each other so as to form a structure having a vertical wall. In FIG. 5 there is shown the stacking of five sub-assemblies 6, each sub-assembly 6 having a depth of 50 cm, so as to form a wall structure 2.5 m high.

Figure 6A:
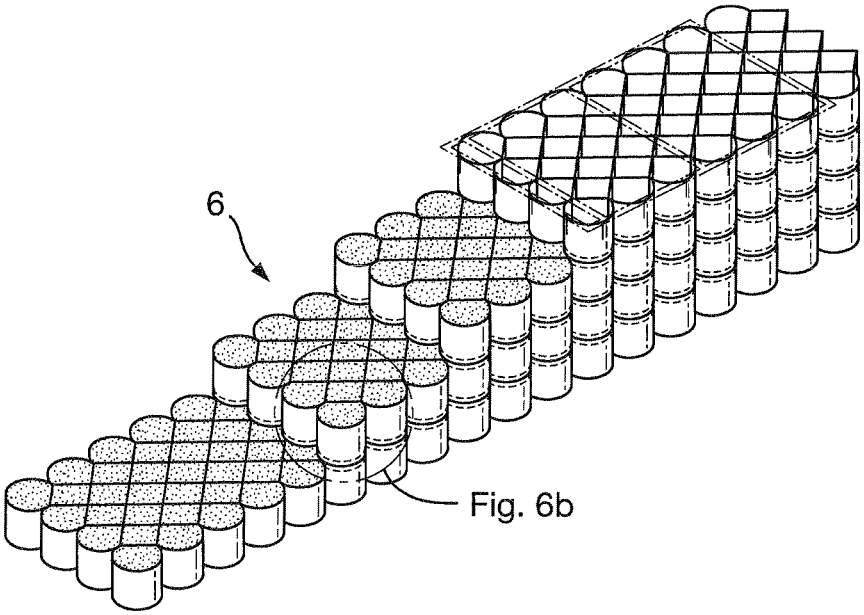
FIG. 6*a* shows a wall system constructed from four sub-assembly layers in accordance with an embodiment of the invention and FIG. 6*b* shows an enlarged view of part of the wall system of FIG. 6*a;*
Figure 6B:
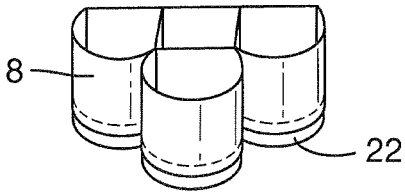

FIGS. 6 and 6*b* show a wall or defensive barrier formed by the above-described stacking technique. It will be appreciated that skirted cell sub-assemblies as described can be used to effectively confine even very fine particulate materials such as sand because the skirting prevents the sand from seeping out between the stacked sub-assemblies. This makes the sub-assemblies particularly suitable for desert environments where there are often no fill materials other than sand available. Sand is also desirable as a fill material due to the high density attainable without compaction.

The skirting provides the confinement necessary to enable stacking of the cellular sub-assemblies to form unclimbable vertical walls and high barriers. The guiding function of the skirts helps to facilitate stacking. Wall construction rates can be very rapid with little manpower required.

It will be appreciated that although the above-described embodiments only show downwardly-extending skirts, such skirts may equally be fitted to the top portion of a cell and extend beyond the top surface of a cellular sub-assembly. Indeed, a sub-assembly could have skirts fitted both at the top and bottom of the cells. This would allow for alternate layering of skirted and un-skirted sub-assemblies.

Figure 7:
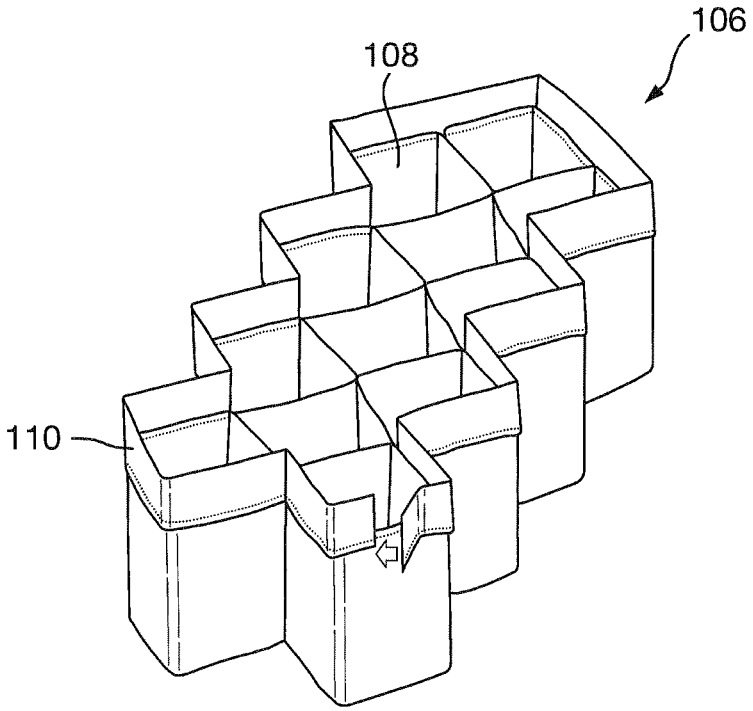
FIG. 7 shows a schematic perspective view of a cellular confinement sub-assembly in accordance with a further embodiment of the present invention.

With reference to FIG. 7, a cellular confinement system in accordance with a further embodiment comprises a sub-assembly 106 of interconnected cells 108 of a geotextile material. The sub-assembly 106 is manufactured as a discrete section containing 12 cells 108. The cells 108 are 50 cm deep. An external skirting strip 110 is fixedly attached around the perimeter of the sub-assembly 106. The skirting strip 110 is in intimate contact with each perimeter cell wall. The skirting strip 110 may be attached to the outside of the cells 108 by sewing or gluing along the dotted line shown. The attachment method used may depend on the respective material(s).

The skirting strip 110 is attached at the upper end of the sub-assembly 106, overlapping with the cell walls and extending upwardly. Typically, the skirting strip is 15 cm deep, 5 cm of which is used to overlap with and attach to the cell walls while 10 cm is left protruding above the sub-assembly 106. The material of the skirting strip 110 is sufficiently rigid that the strip 110 stands vertically without substantially crumpling or bending.

Figure 8A:
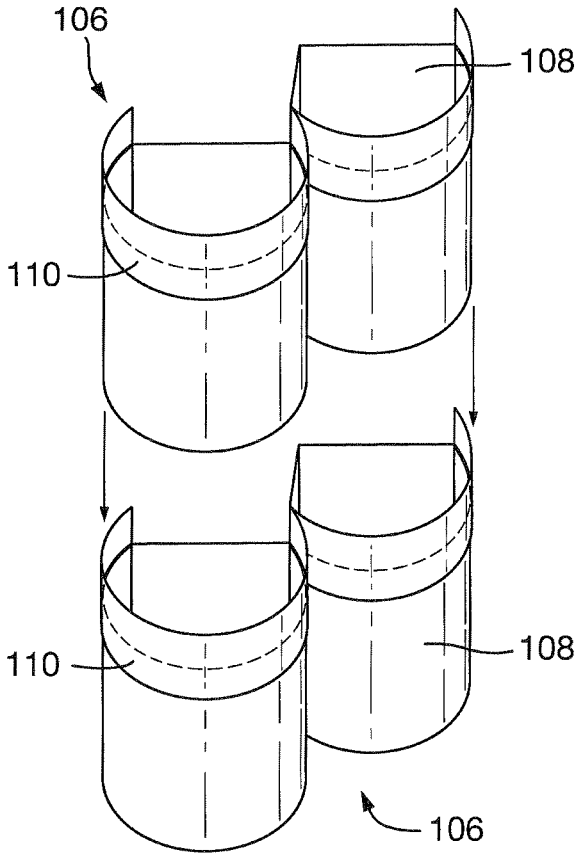
FIG. 8*a* schematically shows the stacking of two sub-assemblies and FIG. 8*b* shows a perspective view of a barrier structure formed by stacking the sub-assemblies.
Figure 8B:
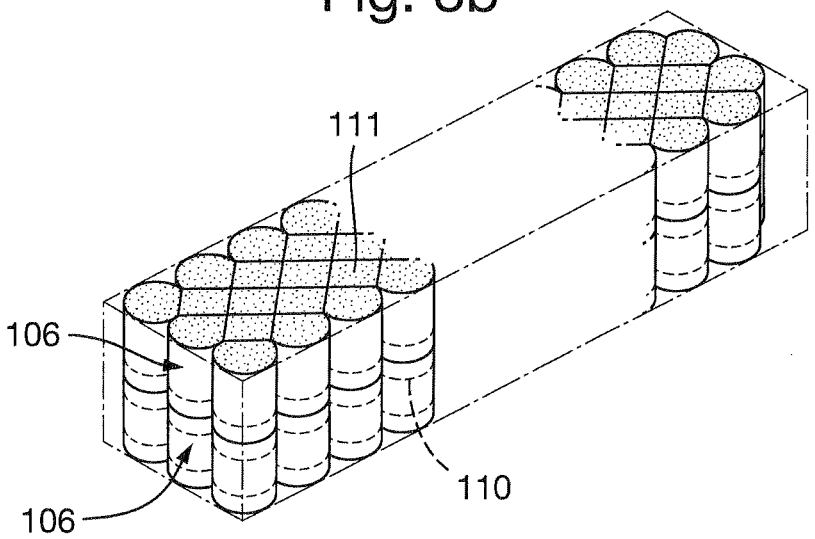

FIG. 8*a* illustrates the stacking of such sub-assemblies 106, the lower portion of the cell walls in an upper layer fitting inside the skirting strip 110 which extends around the perimeter of a lower layer. The resultant wall or barrier structure, as shown in FIG. 8*b*, has substantially vertical perimeter walls on all sides with a seal being formed by the skirting strips 110 between the vertically juxtaposed sub-assemblies 106. The fill material 111 e.g., sand is therefore prevented from leaking out between the stacked layers. The barrier structure seen in FIG. 8*b* is 4.960 m long, 1.216 m wide and 1.0 m high.

As the external skirting strip 110 extends upwardly, the same sub-assembly 106 can advantageously be used in any of the layers of a stacked structure. Thus, a user does not need to select a different sub-assembly for the base layer. The sub-assemblies 106 can be stacked or deployed in any order and can be used the same way up in all of the layers, making it simpler to construct a stacked system. When a second sub-assembly 106 is stacked on top of a first, the lower end of the second sub-assembly 106 slots down inside the external skirting strip 110. The skirting strip 110 therefore overlaps the boundary between layers and prevents the escape of fill material. When a number of layers have been stacked, e.g., to form a wall or barrier, the skirting strip 110 on the top layer can be folded down to at least partially cover the exposed fill material.

It is also envisaged that the sub-assemblies 106 may be deployed inside an outer framework or support system, e.g., within a gabion. The upstanding skirting strip 110 on the uppermost layer may then be folded over or attached to the surrounding framework. For example, a mesh fence or plastic framework may be erected around a stacked system to protect the system from damage and to provide support for the stacked walls. It has been found that deployment of a cellular confinement sub-assembly inside a metal framework can provide enhanced performance under ballistic and blast testing as compared to a single confining layer of geotextile hung inside a metal framework.

Figure 9A:
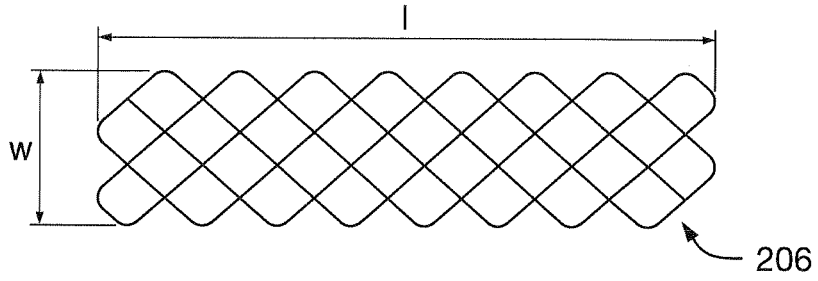
FIGS. 9*a* to 9*c* show a first embodiment of a cellular sub-assembly comprising a perimeter skirt.
Figure 9B:
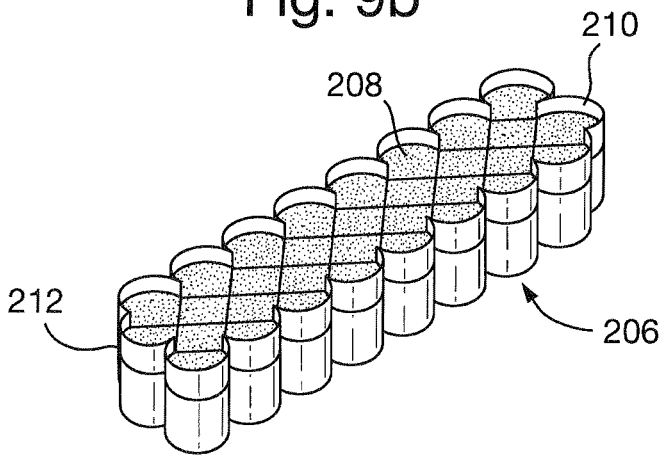
Figure 9C:
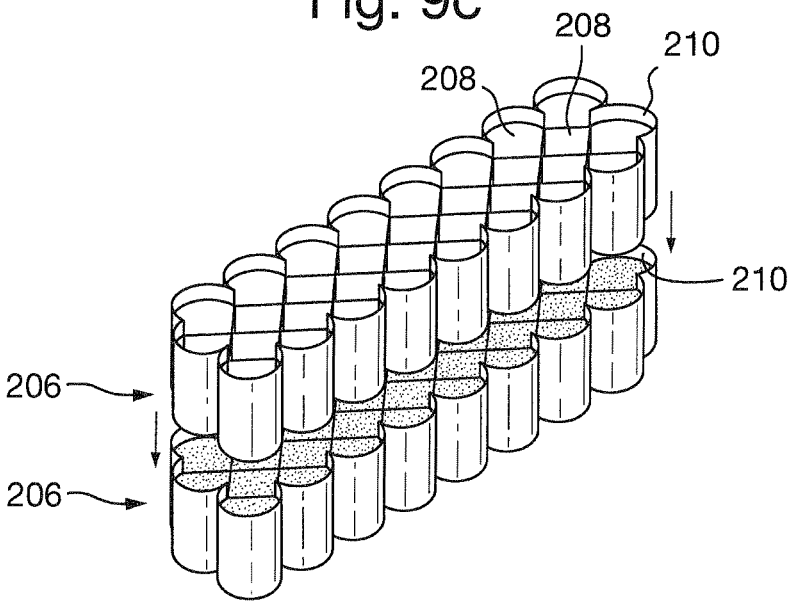

FIGS. 9*a* to 9*c* show a sub-assembly 206 of interconnected cells 208 made from Terram, Typar or similar geotextile material. In one embodiment, when the sub-assembly 206 is opened out it has a width w of 1.25 m and a length l of 5 m. In another embodiment, the sub-assembly 206 has a width w of 54" (1.35 m) and a length l of 194" (4.90 m). The width w represents the footprint of the sub-assembly 206 while the actual protective width may be 43" (1.10 m). In either embodiment, the cells 208 defined between the interconnected cell walls are 500 mm deep. However, the overall height of each sub-assembly 206 at its outer perimeter is 575-600 mm. An upstanding skirt 210 is provided around the upper perimeter of each sub-assembly 206. The skirt 210 extends 75-100 mm above the normal height of the cells 208, i.e., the effective height of the outer cell walls is increased from 500 mm to 575-600 mm. As is shown in FIGS. 9*a* and 9*b*, the perimeter skirt 210 may be integrally formed with the cell walls, or it may be a separate strip which is fixably attached by sewing or gluing along the line 212. Such a perimeter skirt 210 can advantageously prevent the escape of fine fill material such as sand, while the absence of any skirt portions at the inner walls of the sub-assembly 206 permit a high fill density and compaction of the fill materials to be achieved.

In the embodiment seen in FIG. 9*c*, an upstanding skirt portion 210 is integrally formed by the perimeter cell walls having a height that is 100 mm greater than the height of the inner cell walls. It can be seen that when an upper cell sub-assembly 206 is stacked on top of a lower sub-assembly 206, the perimeter cell walls of the upper sub-assembly 206 can be nested inside the upstanding skirt portion 210 of the lower sub-assembly 206 to rest on top of the cells 208 below that have been filled with material such as sand. The skirt portion 210 therefore overlaps the outer perimeter cell walls of the upper sub-assembly 206 and forms a seal that prevents the fill material escaping from between the stacked sub-assemblies 206 at the vertical wall of the barrier that is formed.

In FIGS. 9*a* to 9*c* it can be seen that the sub-assembly 206 is two cells wide but the width of the sub-assembly 206 is not constant along its length. The sub-assembly 206 seen in FIG. 9*c* has a footprint of 54" (1.35 m) and provides a minimum width of 43" (1.10 m) of protection when filled. The outer perimeter of the sub-assembly 206 appears corrugated as a result of the outer rectangular or diamond-shaped cells bulging into a rounded shape when filled. The sub-assemblies 206 can be filled with anything from earth and sand through to small rocks. Individual sub-assemblies 206 can be stacked on top of each other to make higher walls, placed alongside each other to provide greater protection levels, and/or stacked on larger sub-assemblies to make higher structures. When filled, each sub-assembly 206 makes a wall section that is equivalent to about 300 sandbags.

As the sub-assemblies 206 are entirely made from geotextile material, they can be collapsed for transportation and are easily carried manually, with an unfilled sub-assembly 206 weighing less than 15 pounds (6.80 kg). The folded sub-assembly can be dropped from a height with no likelihood of damage, making it ideal for remote locations. The all-textile construction of each sub-assembly 206 means there is no secondary fragmentation from metal or plastic components when used as a barrier for ballistic protection. The rectangular or diamond shape of the cells means that the sub-assemblies easily flatten down into a compact stack.

Figure 10A:
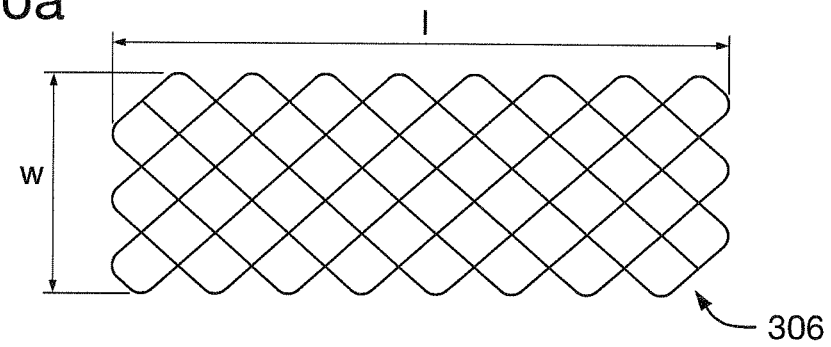
FIGS. 10*a* to 10*c* show a second embodiment of a cellular sub-assembly comprising a perimeter skirt.
Figure 10B:
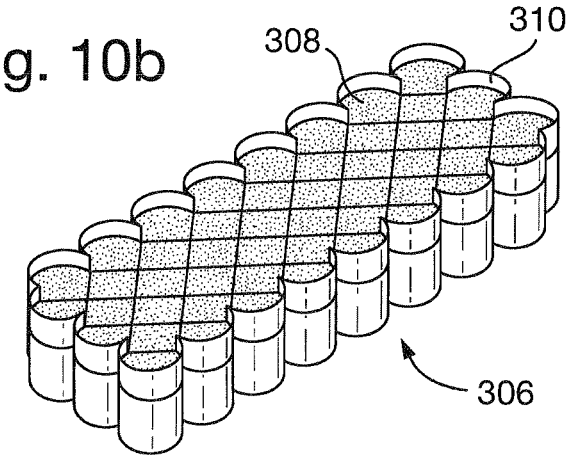
Figure 10C:
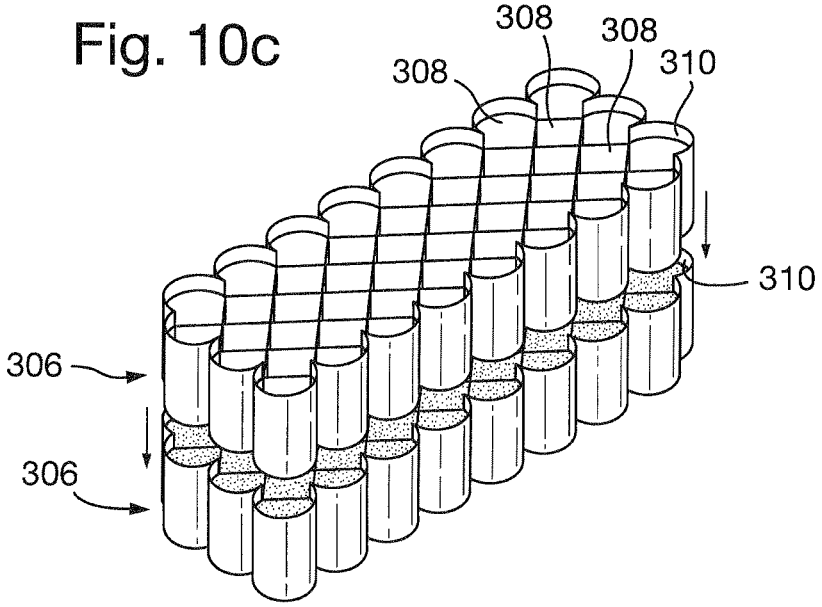

FIGS. 10*a* to 10*c* show another sub-assembly 306 of interconnected cells 308 made from Terram, Typar or similar geotextile material. In one embodiment, when the sub-assembly 306 is opened out it has a width w of 1.75 m and a length l of 1.5 m. In another embodiment, the sub-assembly 306 has a width w of 76" (1.90 m) and a length l of 194" (4.90 m). An upstanding skirt 310 that extends 75-100 mm above the cells 308 is provided around the upper perimeter of the sub-assembly 306. Apart from the increased number of cells and size of the sub-assembly 306, it is substantially the same as the sub-assembly 206 shown in FIGS. 9*a* to 9*c*. Whereas the sub-assembly 206 seen in FIGS. 9*a* to 9*c* is two cells wide, the sub-assembly 306 seen in FIGS. 10*a* to 10*c* is three cells wide and provides a minimum protective width of 65" (1.65 m) when filled.

It can be seen from FIG. 10*c* that the skirt portion 310 may be provided by the outer perimeter cell walls being 75-100 mm higher than the inner cell walls so as to form a continuous skirting strip around the outer perimeter of each sub-assembly 306. When an upper sub-assembly is stacked on top of a lower one, it can be nested inside the perimeter skirt portion 310 so that the skirt portion 310 overlaps with the lower perimeter of the upper sub-assembly.

Figure 11A:
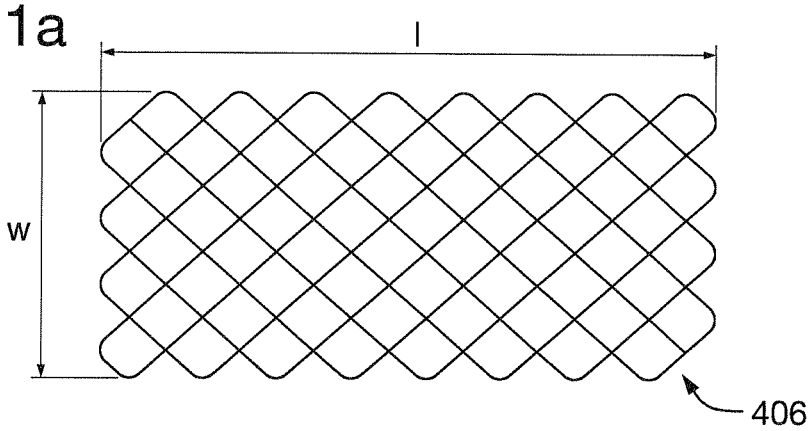
FIGS. 11*a* to 11*c* shows a third embodiment of a cellular sub-assembly comprising a perimeter skirt.
Figure 11B:
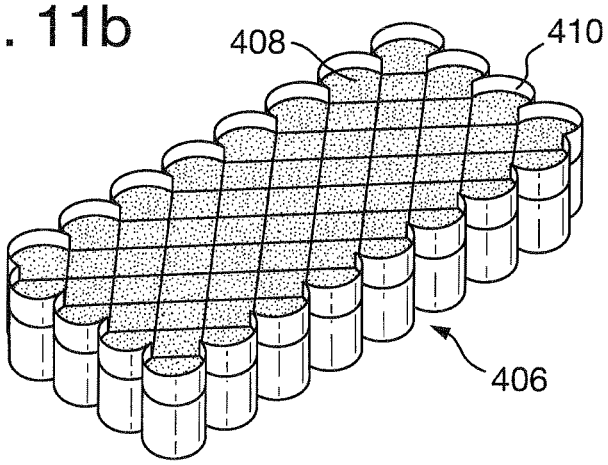
Figure 11C:
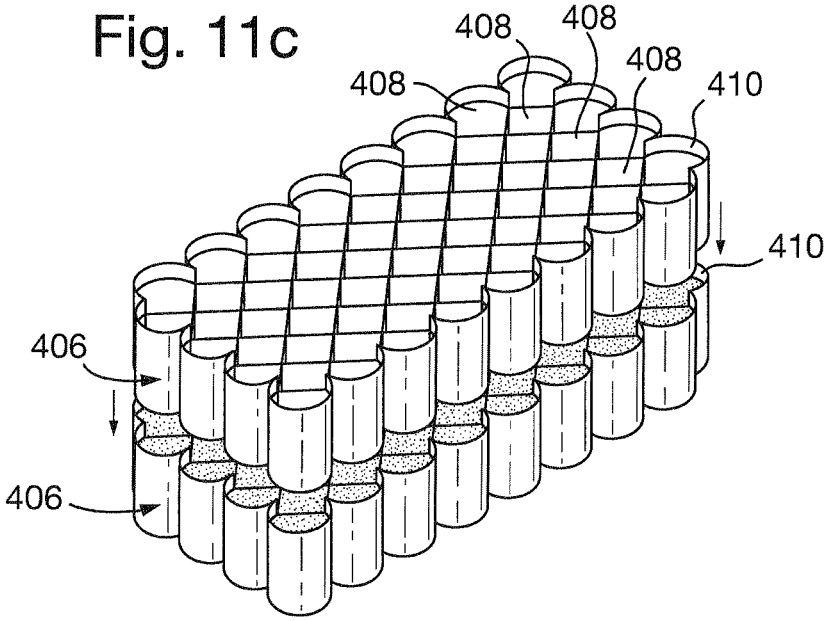

FIGS. 11*a* to 11*c* show another sub-assembly 406 of interconnected cells 408 made from Terram, Typar or similar geotextile material. In one embodiment, when the sub-assembly 406 is opened out it has a width w of 2.25 m and a length l of 5 m. In another embodiment, the sub-assembly 406 has a width w of 98" (2.50 m) and a length l of 194" (4.90 m). An upstanding skirt 410 that extends 75-100 mm above the cells 408 is provided around the upper perimeter of each sub-assembly 406. The sub-assemblies 406 are four cells wide and provide a minimum protective width of 87" (2.25 m) when filled. Apart from the increased number of cells and size of the sub-assembly 406, it is substantially the same as the sub-assemblies 206 and 306 shown in FIGS. 9*a* to 9*c* and 10*a* to 10*c*. It can be seen from FIG. 11*c* that an upper sub-assembly 406 may be stacked on top of a lower sub-assembly 406 to form a wall or barrier unit with the skirt portion 410 overlapping between the vertically juxtaposed sub-assemblies 406 so as to prevent escape of fill material. The skirt portion 410 takes the form of a skirting strip extending continuously around the outer perimeter of the sub-assembly 406.

It can be seen in FIGS. 9*a*-9*c*, 10*a*-10*c* and 11*a*-11*c* that each sub-assembly 206, 306, 406 is formed of generally rectangular or diamond-shaped cells. The sub-assemblies may be formed from a continuous strip of geotextile material which is folded back and forth on itself, the folded layers being bonded (e.g., by adhesive, stitching or other means) to each other at spaced apart locations so as to define the cells. The resulting cellular structure provides outer perimeter walls that are not flat but corrugated.

Figure 12:
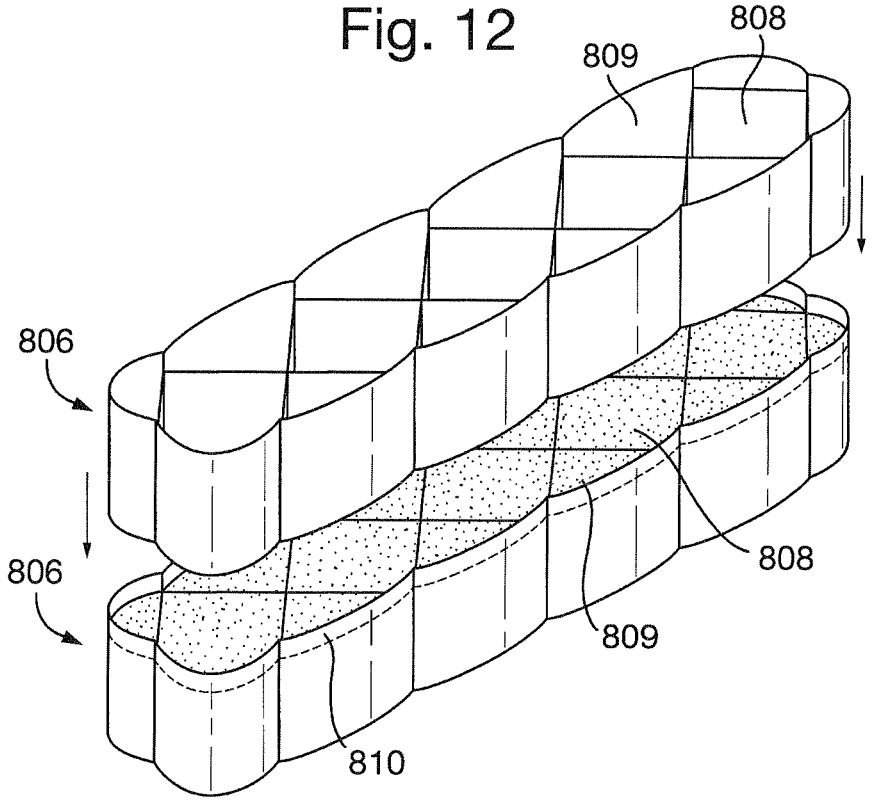
FIG. 12 shows a fourth embodiment of a cellular sub-assembly comprising a perimeter skirt.

FIG. 12 shows another sub-assembly 806 of interconnected cells 808 made from Terram, Typar or similar geotextile material. The sub-assembly 806 is only one cell wide. When opened out and filled, the sub-assembly 806 provides a wall section that is 126" (3.20 m) long, 28" (0.70 m) wide, and 24" (0.6 m) high, which is equivalent to about 100 sandbags. When collapsed and packed, the sub-assembly 806 represents a very lightweight unit with a low volume that can fit in the same space as a single full sandbag. The weight of the collapsed geotextile unit is only 3.6 kg. When opened out, the sub-assembly 806 can be filled with material ranging from earth and sand through to rocks up to about 20 cm in diameter. The sub-assembly 806 has the same advantages discussed above in relation to FIGS. 9 to 11, such as ballistic protection and the ability to stack sub-assemblies 206 on top of each other and/or side by side to provide greater protection levels.

It can be seen from FIG. 12 that the outer perimeter of each sub-assembly 806 is formed from a continuous strip of geotextile material having a height of 24" (600 mm). The inner cellular structure is made as a discrete sub-assembly section of interconnected rectangular or diamond-shaped cells 808. The inner cell walls are formed from a continuous strip of geotextile material that is 20" (500 mm) deep, folded back on itself and fastened (e.g., glued or sewn) at spaced apart locations. Alternatively, two or more strips of geotextile material may be fastened together at spaced apart locations along their length to form the inner cellular section. A continuous strip of geotextile material that is 23-24" (575-600 mm) deep is then wrapped around the cellular section to form the outer perimeter of the sub-assembly 806 with a skirting strip 810 that extends 75-100 mm above the inner cells 808. The perimeter strip of geotextile can be pulled tight before being fastened at spaced apart locations to the inner cellular section, so that the outer cells 809 of the sub-assembly 806 are triangular in shape, rather than rectangular or diamond-shaped like the inner cells 808. The sub-assembly 806 therefore has perimeter walls that are substantially flat rather than corrugated.

The wider strip of geotextile around the perimeter of the sub-assembly 806 provides an integrally formed skirting strip 810 that is 3-4" (75-100 mm) higher than the inner cells 808 and extends continuously around the perimeter cell walls. When an upper sub-assembly 806 is stacked on top of a lower sub-assembly 806, it can rest on top of the cells 808 in the lower sub-assembly 806 that have been filled with a material e.g. sand and therefore nests inside the skirting strip 810 provided by the perimeter wall of the outer cells 809, which forms a seal across the vertically juxtaposed sub-assemblies 806 to prevent escape of fill material at the vertical wall thereby formed.

Figure 13:
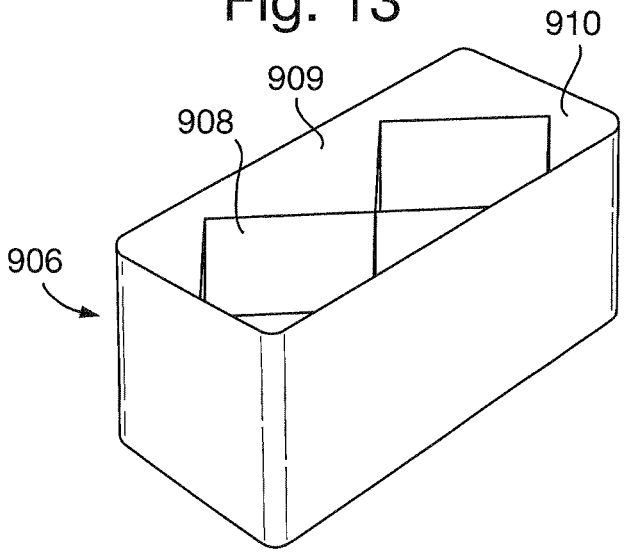
FIG. 13 shows a fifth embodiment of a cellular sub-assembly comprising a perimeter skirt.

FIG. 13 shows another sub-assembly 906 that is a shorter version of the sub-assembly 806 seen in FIG. 12. The sub-assembly 906 is one cell wide and only two cells long, whereas the sub-assembly 806 seen in FIG. 12 is five cells long. As a result, the sub-assembly 906 is exceptionally lightweight, the collapsed cells of geotextile material weighing only 1.4 kg. When opened out, the sub-assembly 906 can be filled in less than 10 minutes by hand, however it is the equivalent of over 40 sandbags. The sub-assembly 906 is ideal for firing positions and pop-up target protection. Being completely non-metallic, the use of geotextile material ensures there is no risk of ricochet or secondary shrapnel. When opened out, the sub-assembly 906 has a width w of 28" (0.70 m) and a length l of 50" (1.30 m).

The sub-assembly 906 is formed of an inner cellular section of interconnected rectangular or diamond-shaped cells 908 made from Terrain, Typar or similar geotextile material. A wider piece of geotextile material forms a perimeter around the inner cellular section to define triangular perimeter cells 909. A skirting strip 910 is integrally provided by the outer perimeter walls to provide an upstanding skirt portion extending 3-4" (75-100 mm) above the height of the inner cell walls. The sub-assembly 906 may be manufactured in the same way as is described in relation to FIG. 12. The inner cells 908 may be formed from a single strip of geotextile material that is folded back on itself and fastened at spaced apart locations, resulting in a honeycomb structure that can be opened out to form the rectangular or diamond-shaped cells 908. The wider strip of geotextile around the perimeter of the cellular section ensures that the perimeter walls of the sub-assembly 906 are substantially flat rather than corrugated.

Figure 14:
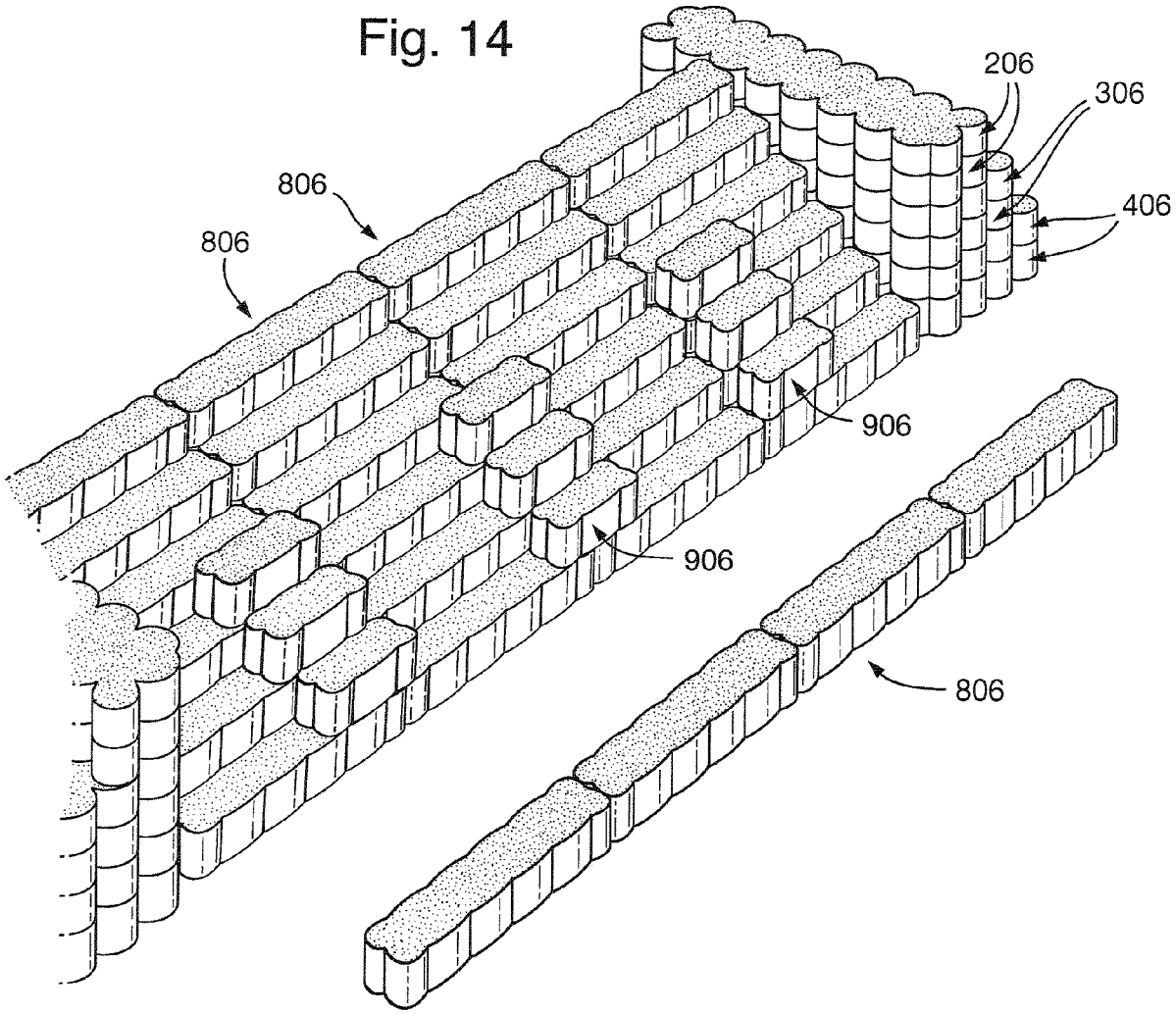
FIG. 14 illustrates a barrier and wall construction made up of various sub-assemblies.

FIG. 14 illustrates how various barriers may be formed by co-locating and/or stacking sub-assemblies 206, 306, 406, 806, 906 of different sizes. There is a large degree of flexibility in how the sub-assemblies may be used to build walls and barriers in applications such as range dividers, target protection, live firing, close quarters battle (CQB) and shoot houses. A fine fill material such as sand can be compacted to provide highly stable walls and barriers providing high levels of protection and long term stability. The perimeter skirt portions of each sub-assembly mean that the walls and barriers can be built with vertical faces, while the geotextile material of the cells ensures that there is no ricochet from bullets and the like.

Figure 15:
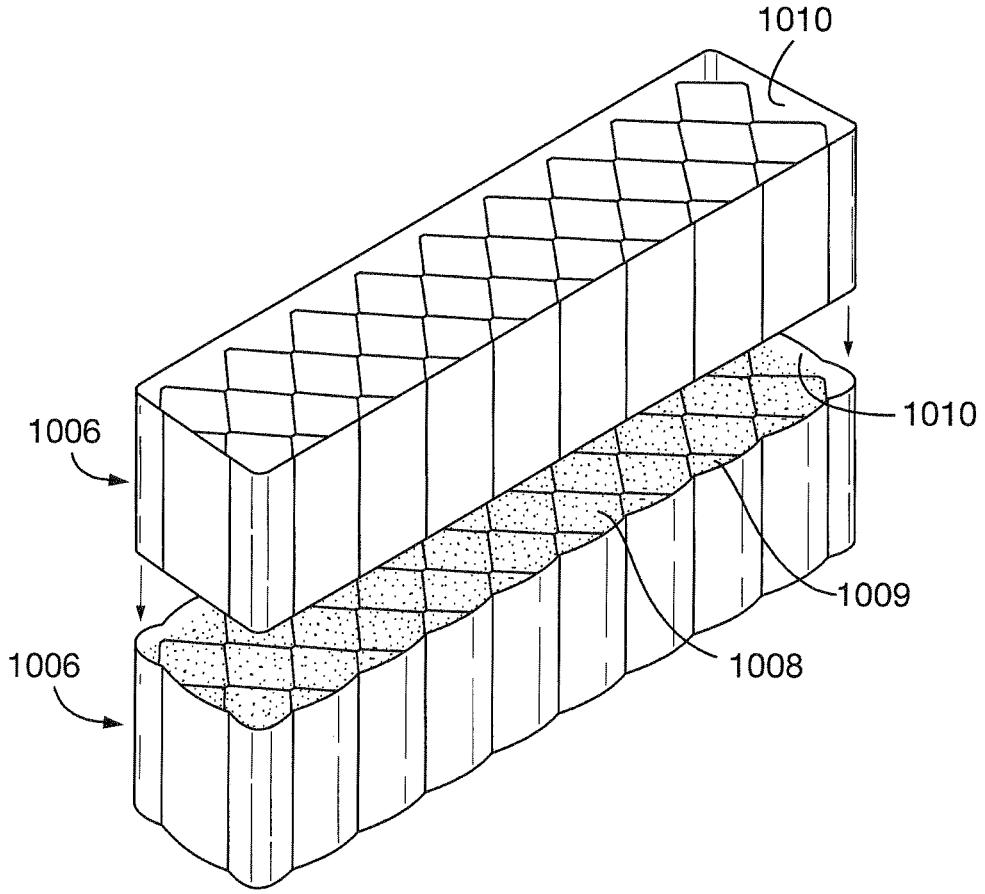
FIG. 15 shows a sixth embodiment of a cellular sub-assembly comprising a perimeter skirt.

FIG. 15 shows a sub-assembly 1006 of interconnected cells 1008 made from Terram, Typar or similar geotextile material. The sub-assembly 1006 is a larger version of the sub-assembly 806 seen in FIG. 12, being two cells wide rather than one cell wide and eight cells, rather than five cells, long. When opened out, the sub-assembly 1006 has a width of 39" (100 m) and a length l of 194" (4.94 m). The cells are also deeper, the inner cells 1008 having a wall height of 24" (600 mm) while the outer perimeter cells 1009 of the sub-assembly 1006 have an outer wall height of 28" (700 mm). The skirt portion 1010 formed around the outer perimeter of the sub-assembly 1006 is 4" (100 mm) deep. As in the embodiments of FIGS. 12 and 13, the inner cells 1008 are rectangular or diamond-shaped while the outer perimeter cells 1009 are triangular. The outer perimeter wall cannot substantially bulge out so that the sub-assembly 1006 has a generally flat, rather than corrugated, outer wall. The size of this sub-assembly 1006 offers increased ballistic protection against a wide range of blast and ballistic threats. The filled unit is equivalent to over 300 sandbags and provides a barrier that can protect from smalls arms up to 20 mm in size and from substantial attacks involving mortar and rockets. The non-metallic construction ensures no secondary shrapnel threat, ricochet or RF interference. Of course, such a sub-assembly 1006 can be stacked underneath, on top of, or alongside other sub-assemblies to build different structures in a manner similar to that illustrated in FIG. 14.

Figure 16A:
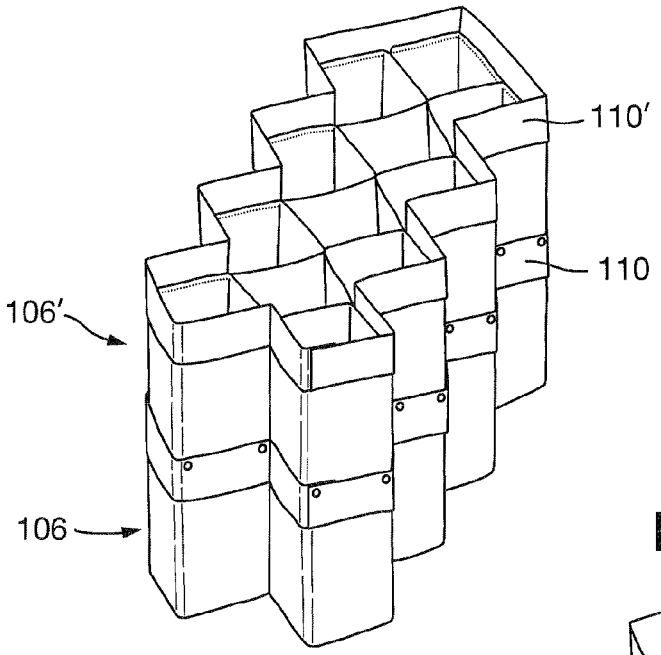
FIGS. 16*a* to 16*c* show a plastic fastener as seen in FIG. 16*c* being used to fasten a skirting strip in FIG. 16*a* and a patch in FIG. 16*b;*

FIG. 16*a* illustrates the way in which fasteners 130, preferably made of plastic, may be used to attach a skirting strip 110 to the cell walls of a sub-assembly 106'. In the embodiment shown, a skirting strip 110, 110' extends around the outer perimeter of each sub-assembly 106, 106' at its top edge. The skirting strips 110, 110' may be attached to the respective sub-assemblies 106, 106' by any suitable method, such as gluing or sewing. They may be integrally formed with the cells instead of being a separate strip.

Where the skirting strip 110 of a lower sub-assembly 106 overlaps with the cell walls of an upper sub-assembly 106' which is stacked on top, fasteners 130 may be used to couple the overlying skirting strip 110 to the upper sub-assembly 106'. The fasteners 130 can advantageously prevent the skirting strip 110 from gaping away from the cell walls and ensure that the skirting strip 110 stands vertically. They can also help to strengthen the stacked system, e.g., where used as a crash barrier.

An exemplary plastic fastener 130 comprises a stem 132 which is about 19 mm long and has a diameter of about 8 mm, and a head 134 with a diameter of about 18 mm. The fastener 130 is therefore rather small and unobtrusive. It may also pose little risk as shrapnel if the system is impacted or blown apart. The stem 132 of the fastener 130 is barbed such that the fastener 130 can hold itself in place once pushed through the fabric material of a skirting strip 110 and a sub-assembly cell wall. A pilot hole may first be made through the overlapping layers using a suitable tool, and then the fastener 130 may be pushed through the hole to hold the layers closely together. It is also envisaged that the fastener 130 itself may be sharp enough to be pushed through the material layers.

Figure 16B:
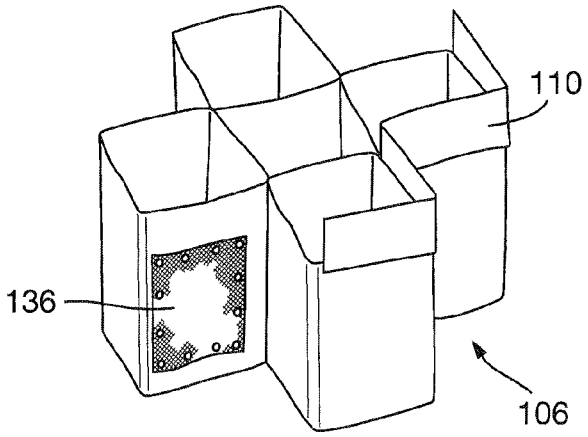
Figure 16C:
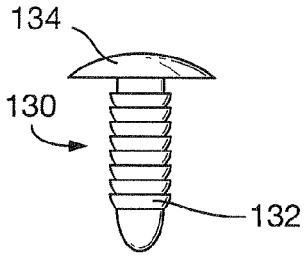

Another use of the plastic fastener 130 is shown in FIG. 16*b*. In this embodiment, the fasteners 130 are used to attach a patch 136 to repair a damaged cell wall in a sub-assembly 106.

Figure 17:
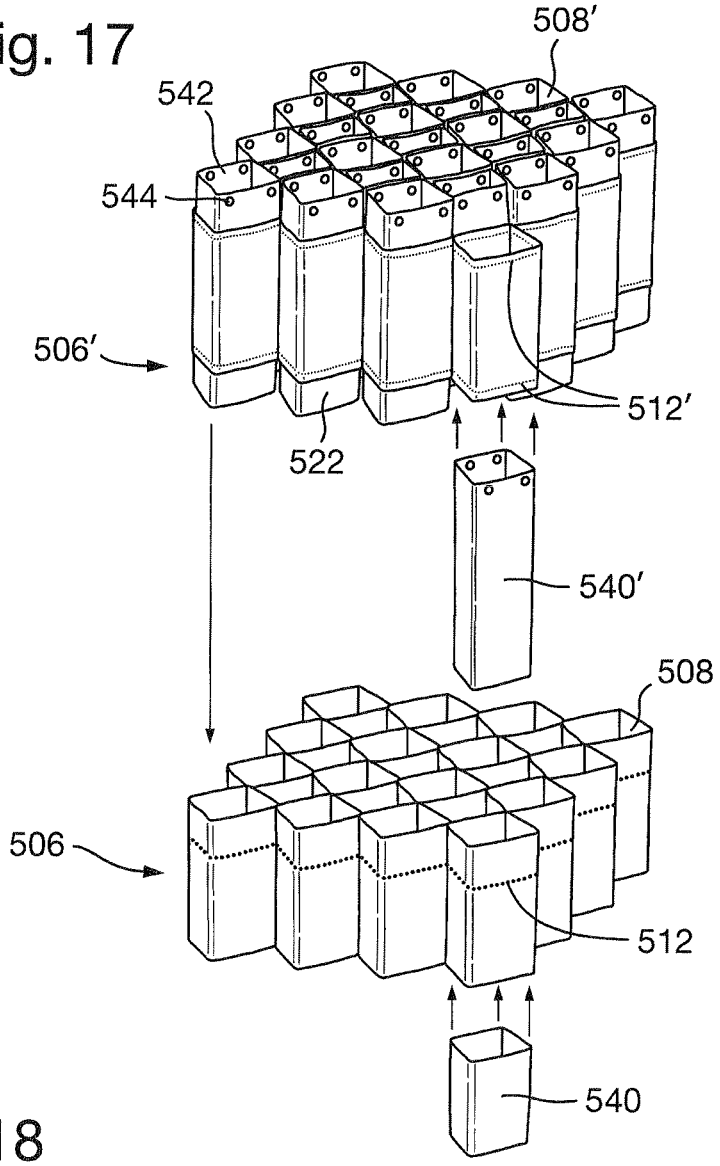
FIG. 17 shows a schematic perspective view of a cellular confinement system formed from sub-assemblies and inner tubes.
Figure 18:
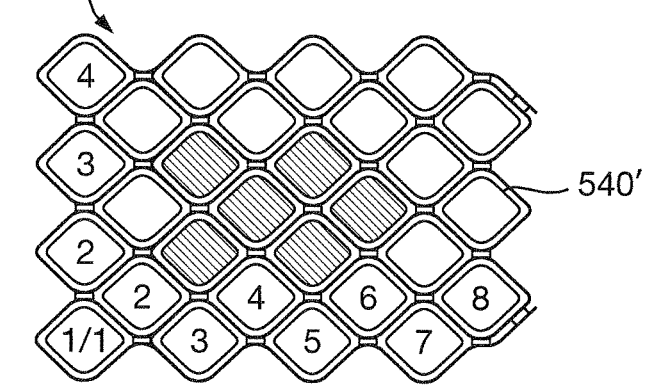
FIG. 18 shows a plan view of the system of FIG. 17.

With reference to FIGS. 17 and 18, stackable sub-assemblies 506, 506' according to an alternative embodiment comprise interconnected geotextile cells 508, 508' each of which are provided with a tubular insert 540, 540'. The inserts 540, 540' may be secured into each cell, for example by gluing or sewing along the lines 512, 512' shown. The inserts 540, 540' may be attached at the top and/or bottom of each cell. A reinforcing sheet (not shown) may be sandwiched between an insert 540, 540' and an adjacent cell wall, to provide further strengthening.

In certain sub-assembly layers, such as the base layer 506 in a stacked system, the tubular insert 540 has a depth which is less than the height of the cell 508. For example, the cells 508 may be 750 mm high while the insert 540 is only 500 mm deep. This can leave a depth of 250 mm at the top of each cell 508 which is free to receive a downwardly extending skirt 522 from an upper layer 506'. The insert 540 in these layers 506 can advantageously strength the system.

In other sub-assembly layers, such as an upper layer 506', the tubular insert 540' has a height greater than that of the cells 508'. The height of the insert 540' may be chosen depending on its location in the sub-assembly 506' and whether a skirt portion is desired at the top and/or bottom of the cells 508'. For example, where the cells are 750 mm deep, at least some of the inserts 540' may be 1250 mm deep, leaving a skirt portion 542 which is 250 mm deep extending out of the top of the cells 508' and a skirt portion 522 which is 250 mm deep extending out of the bottom of the cells 508'. Alternatively, the insert 540' may be 1000 mm deep so as to form a 250 mm deep skirt portion extending from only one end of the cells 508'.

When the layers 506, 506' shown are stacked on top of one another, the downwardly extending skirt portions 522 of the upper sub-assembly 506' slot into the cells 508 of the lower sub-assembly 506 and abut the inserts 540. As can be seen from the plan view of a sub-assembly 506' shown in FIG. 18, some of the inner cells 508' (shaded) can be provided with a 1000 mm insert 540' which provides only an upwardly extending skirt portion 542. These inner cells 508' do not, therefore, interlock with the cells 508 of the lower layer 506. This can make it easier to stack the sub-assemblies 506, 506'. However, all of the cells 508' in the upper sub-assembly are provided with top skirt portions 542. The upwardly extending skirt portions 542 can be used to interlock with another sub-assembly layer, for example, another sub-assembly 506 without skirt portions which has been turned upside down so as to leave the 250 mm clearance at the bottom of the cells 508 to accommodate the up-skirts 542. However, in at least some embodiments, the up-skirts 542 are used instead to close off the open cells 508' of the upper layer 506'. The upper skirt portions 542 are provided with eyelets 544. A drawstring (not shown) can be threaded through the eyelets 544 and used to pull the skirt portion 542 closed on top of each cell 508'. This is possible due to the flexibility of the geotextile material used for the inserts 540'. It will be appreciated that the inserts 540 in the base layer 506 may be formed of a stiffer material, e.g., for reinforcing purposes, as they do not form skirt portions or a closure system.

Cellular sub-assemblies used in embodiments of the present invention may be formed using any suitable technique. For example, they may be formed from a concertinaed strip of geotextile material as shown in FIG. 1. They may also be found in discrete sections of interconnected cells.

Figure 19B:
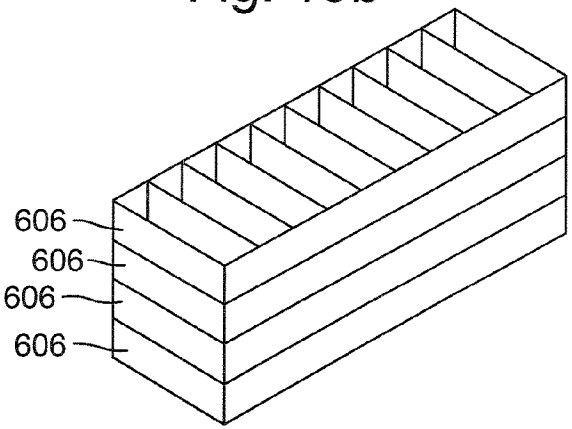
FIGS. 19*a* and 19*b* show rectangular cellular sub-assemblies in accordance with an alternative embodiment of the invention.
Figure 19A:
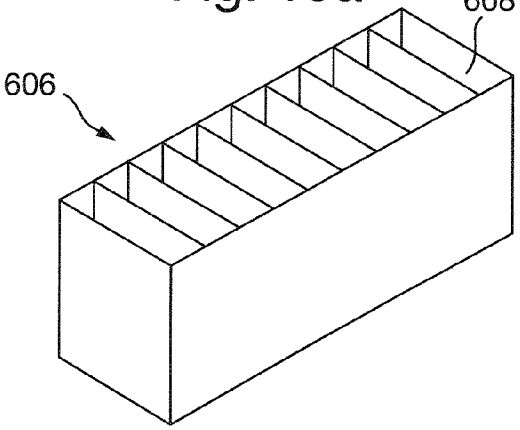

There is shown in FIG. 19*a* a cellular sub-assembly 606 formed of interconnected cells 608 having a generally rectangular shape. FIG. 19*b* shows a cellular confinement system for soil, sand or other filler material made up from a number of the sub-assemblies 606 stacked on top of one another to form generally vertical walls. Skirt portions, although not shown, may be used to seal at least the outer perimeter of the cells 608 from the escape of fill material between the layers.

Figure 20B:
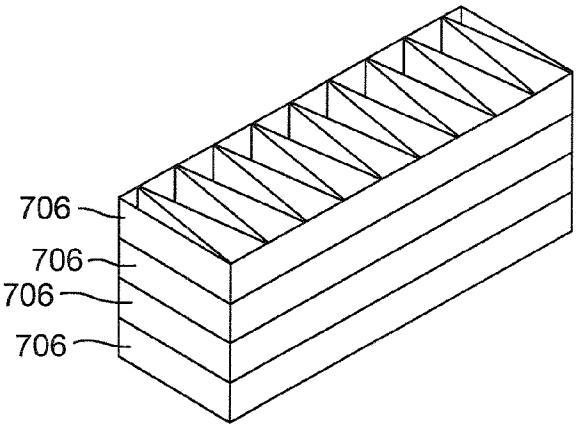
FIGS. 20*a* and 20*b* show triangular cellular sub-assemblies in accordance with another alternative embodiment of the invention.
Figure 20A:
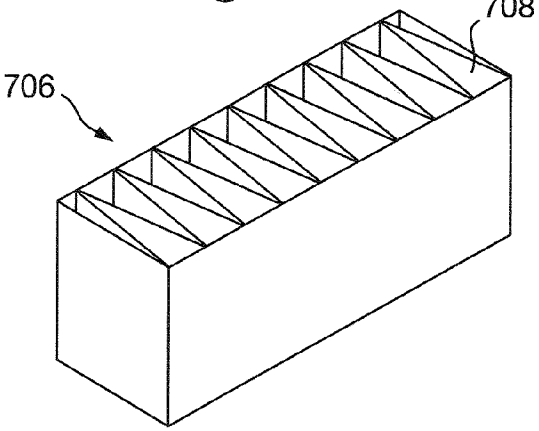

There is shown in FIG. 20*a* a cellular sub-assembly 706 formed of interconnected cells 708 having a generally triangular shape. FIG. 20*b* shows a cellular confinement system for soil, sand or other filler material made up from a number of the sub-assemblies 706 stacked on top of one another to form generally vertical walls. Skirt portions, although not shown, may be used to seal at least the outer perimeter of the cells 708 from the escape of fill material between the layers.

Figure 21:
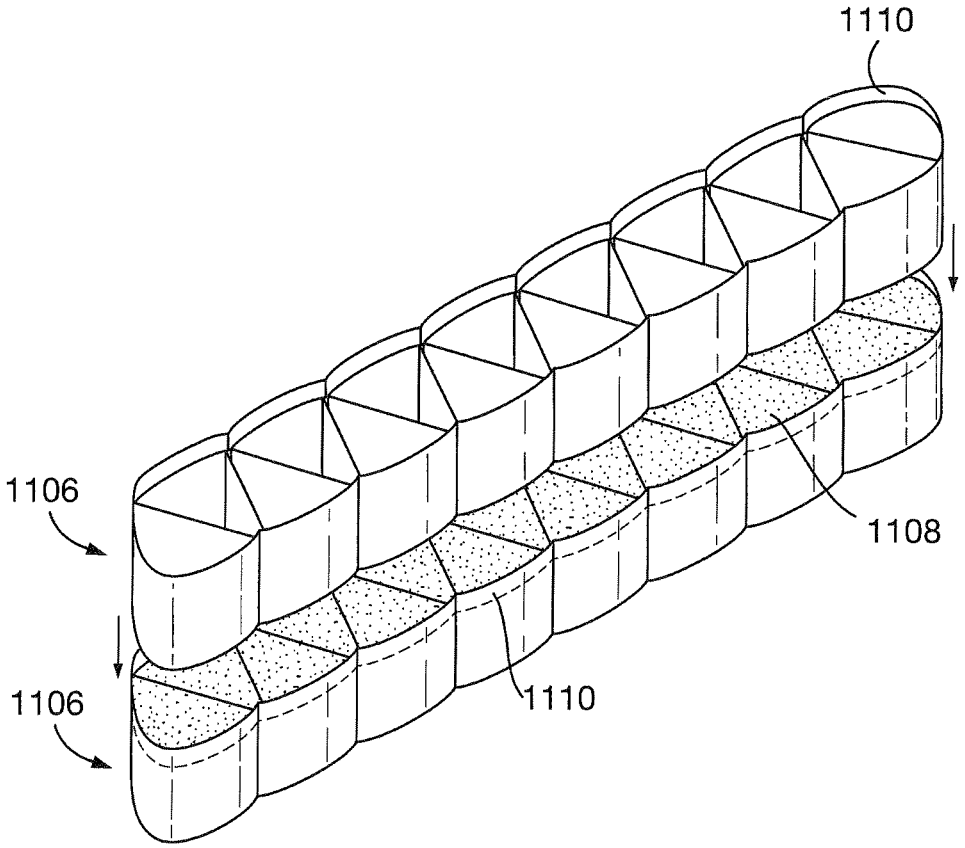
FIG. 21 shows a seventh embodiment of a cellular sub-assembly comprising a perimeter skirt.

There is shown in FIG. 21 a cellular sub-assembly 1106 formed of interconnected cells 1108 made from Terram, Typar or similar geotextile material. Similar to the sub-assembly 706 seen in FIGS. 20*a* and 20*b*, all of the cells 1108 have a generally triangular shape rather than being rectangular or diamond-shaped. The sub-assembly 1106 that can be folded into a compact unit that fits in the same space as a full sandbag. When opened out and filled, the sub-assembly 1106 makes a wall section having a width of 28" (0.70 m), a length of 194" (4.90 m) and a height of 24" (600 mm) The sub-assembly 1106 may be formed from just two strips of geotextile material. A strip of material that forms the inner cell walls has a height of 20" (500 mm) and may be zig-zag folded to create the side walls of the triangular cells. Of course, multiple strips may be fastened end-to-end to increase the length of the zig-zag as required. Another strip of geotextile material having a depth of 24" (600 mm) can be wrapped around the inner strip and fastened at spaced apart locations to the zig-zag folds (e.g., by gluing or sewing) so as to form the end walls of each triangular cell. This results in the sub-assembly 1106 having an integral skirting strip 1110 of depth 4" (100 mm) upstanding around its outer periphery. When one sub-assembly 1106 is stacked on top of another, as is seen in FIG. 21, the upper unit 1106 is nested inside the skirting strip 1110 upstanding from the lower unit 1106 so that a seal is formed between the vertically juxtaposed sub-assemblies along the vertical perimeter walls.

It can be seen that the perimeter cell walls are substantially taut and do not tend to bulge out when filled. The triangular shape of the cells ensures that the sub-assembly 1106 has substantially flat, rather than corrugated, walls. This means that the sub-assembly 1106 has a generally constant width along its length. The shape and/or size of the triangular cells may be adjusted depending on the locations at which the geotextile strips are fastened together. Various techniques may be used to fasten the geotextile material forming the cellular structure, including gluing, sewing, thermal lamination, ultrasonic welding, etc.

It will be appreciated that cells of any desired size and shape can be used. The cell shape may be adjusted, for example, to improve the overall strength of the cellular system.

Although geotextile materials such as those manufactured by Terram Ltd. have been described as being particularly suitable for forming sub-assemblies and cellular confinement systems, it will be appreciated that many different types of fabric material may be used in accordance with the invention. For example, geotextile materials manufactured by Fiberweb Inc. may also be used. Suitable geotextile materials may be sold under the Typar® brand.

The invention claimed is:

1. A sub-assembly for a cellular confinement system for soil, sand or other filler material, the sub-assembly formed of a plurality of interconnected open cells of fabric material, wherein at least some of said interconnected open cells comprise a skirt portion extending from one or more respective walls of the cells no further than a cell wall of a vertically juxtaposed sub-assembly, said skirt portion being integral with the one or more respective walls and forming a skirting strip around an outer perimeter of the sub-assembly.

2. The sub-assembly as claimed in claim 1, wherein only the walls of the cells at the outer perimeter of the sub-assembly are provided with said skirt portion.

3. The sub-assembly as claimed in claim 1, wherein said skirt portion is provided around the outer perimeter of the sub-assembly by an increased height of the walls of the cells at the outer perimeter of the sub-assembly.

4. The sub-assembly as claimed in claim 1, wherein said skirt portion and at least one of the walls of the cells are formed of the same flexible fabric material.

5. The sub-assembly as claimed in claim 1, wherein said skirt portion is foldable for closing at least some of the cells of the sub-assembly.

6. The sub-assembly as claimed in claim 1, wherein the interconnected cells of the sub-assembly are formed from at least one continuous strip of fabric material, and the at least one continuous strip is folded back and forth on itself, the folded layers being bonded to each other at spaced apart locations such that the fabric material is opened out to form at least part of the cellular sub-assembly.

7. The sub-assembly as claimed in claim 1, wherein the interconnected cells of the sub-assembly are formed in one or more discrete sub-assembly sections.

8. The sub-assembly as claimed in claim 1, wherein the interconnected cells of the sub-assembly are surrounded by a continuous strip of fabric material that forms the perimeter of the sub-assembly, the continuous strip of fabric material having a height that is greater than the height of the cells so as to integrally form said skirt portion around the perimeter of the sub-assembly.

9. A sub-assembly for a cellular confinement system for soil, sand or other filler material, the sub-assembly formed of a plurality of interconnected open cells of fabric material manufactured in at least one discrete cellular section, and comprising a wider piece of fabric than the cellular section, said wider piece of fabric extending around the perimeter of the cellular section to form perimeter walls for the cells with an integral skirt portion.

10. The sub-assembly as claimed in claim 9, wherein said skirt portion and at least one of the walls of the cells are formed of the same flexible fabric material.

11. The sub-assembly as claimed in claim 9, wherein said skirt portion is foldable for closing at least some of the cells of the sub-assembly.

12. A sub-assembly for a cellular confinement system for soil, sand or other filler material, the sub-assembly formed of a plurality of interconnected open cells of flexible fabric material having a generally triangular shape, wherein at least some of the cells are provided, at least in use, with a skirt portion extending from one or more respective walls of the cells, said skirt portion being integral with the one or more respective walls and including a skirting strip around an outer perimeter of the sub-assembly.

13. A sub-assembly as claimed in claim 12, wherein said skirt portion is associated with the cells at the outer perimeter of the sub-assembly.

14. A sub-assembly as claimed in claim 12, wherein walls of the cells and the skirt portion are formed of the same flexible fabric material.

15. A frameless cellular confinement system for soil, sand or other filler material, the system comprising a plurality of sub-assemblies formed of a plurality of interconnected open cells of fabric material, the sub-assemblies being stackable one on top of the other to provide a structure having at least one generally vertical side wall or at least one generally vertical wall, wherein the cells have perimeter walls including a skirt portion that is integral with said perimeter walls and arranged between vertically juxtaposed sub-assemblies in use to substantially prevent or minimise finer aggregate material escaping from between the stacked sub-assemblies at said generally vertical side wall or said generally vertical end wall.

16. The system as claimed in claim 15, wherein said skirt portion extends from the top or bottom of each sub-assembly to overlap the inner or outer surface of the perimeter cell walls in a vertically juxtaposed sub-assembly.

17. The system as claimed in claim 15, wherein a skirt portion of a first sub-assembly is fastenable to the perimeter walls of a second, vertically juxtaposed sub-assembly in use.

18. The system as claimed in claim 17, wherein said skirt portion is fastened to the perimeter walls of a second, vertically juxtaposed sub-assembly using one or more fasteners made of a plastics material.

* * * * *